US010991314B2

(12) United States Patent
Park et al.

(10) Patent No.: US 10,991,314 B2
(45) Date of Patent: Apr. 27, 2021

(54) SCAN DRIVER AND DISPLAY DEVICE HAVING THE SAME

(71) Applicant: Samsung Display Co., Ltd., Yongin-si (KR)

(72) Inventors: Jun Hyun Park, Yongin-si (KR); Dong Woo Kim, Yongin-si (KR); Sung Jae Moon, Yongin-si (KR); An Su Lee, Yongin-si (KR); Kang Moon Jo, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/700,968

(22) Filed: Dec. 2, 2019

(65) Prior Publication Data

US 2020/0193912 A1 Jun. 18, 2020

(30) Foreign Application Priority Data

Dec. 12, 2018 (KR) ..... 10-2018-0160171

(51) Int. Cl.

| | |
|---|---|
| ***G06F 3/038*** | (2013.01) |
| ***G09G 5/00*** | (2006.01) |
| ***G09G 5/10*** | (2006.01) |
| ***G09G 3/3266*** | (2016.01) |
| ***G09G 3/3275*** | (2016.01) |
| ***G09G 3/3233*** | (2016.01) |

(52) U.S. Cl.

CPC ..... *G09G 3/3266* (2013.01); *G09G 3/3233* (2013.01); *G09G 3/3275* (2013.01); *G09G 2310/0291* (2013.01); *G09G 2310/061* (2013.01); *G09G 2310/08* (2013.01)

(58) Field of Classification Search

CPC ..... G09G 2310/0286; G09G 3/3266

See application file for complete search history.

(56) References Cited

U.S. PATENT DOCUMENTS

2012/0056858 A1* 3/2012 Ahn ..... G09G 3/3677 345/204

2017/0365211 A1 12/2017 Lee et al.

(Continued)

FOREIGN PATENT DOCUMENTS

KR 10-2016-0073928 6/2016

KR 10-2017-0143052 12/2017

(Continued)

*Primary Examiner* — Nan-Ying Yang

(74) *Attorney, Agent, or Firm* — H.C. Park & Associates, PLC

(57) ABSTRACT

A scan driver includes stages for outputting scan signals. An nth stage includes: a first driving controller for controlling a voltage of a first node and a voltage of a second node in response to a previous carry signal; a second driving controller for controlling a voltage of a first driving node, based on a sensing-on signal, a next carry signal, the voltage of a first power source, the voltage of the first node, and a voltage of a sampling node, and controlling a voltage of a second driving node, based on the voltage of the sampling node and a sensing clock signal; an output buffer for outputting a carry signal and the scan signal; and a connection controller for electrically coupling the first node and the first driving node and electrically coupling the second node and the second driving node, in response to a display-on signal.

27 Claims, 21 Drawing Sheets

(56) References Cited

U.S. PATENT DOCUMENTS

| | | | | |
|---|---|---|---|---|
| 2018/0337682 | A1* | 11/2018 | Takasugi ..... | G09G 3/3241 |
| 2020/0184898 | A1 | 6/2020 | Choi et al. | |
| 2020/0202761 | A1 | 6/2020 | Choi et al. | |
| 2020/0258446 | A1 | 8/2020 | Choi et al. | |

FOREIGN PATENT DOCUMENTS

| | | |
|---|---|---|
| KR | 10-2018-0031879 | 3/2018 |
| KR | 10-2020-0071206 | 6/2020 |
| KR | 10-2020-0077665 | 7/2020 |
| KR | 10-2020-0083763 | 7/2020 |
| KR | 10-2020-0097382 | 8/2020 |
| KR | 10-2020-0100247 | 8/2020 |

* cited by examiner

SCAN DRIVER AND DISPLAY DEVICE HAVING THE SAME

CROSS-REFERENCE TO RELATED APPLICATION

This application claims priority from and the benefit of Korean Patent Application No 10-2018-0160171, filed on Dec. 12, 2018, which is hereby incorporated by reference for all purposes as if fully set forth herein.

BACKGROUND

Field

Exemplary embodiments/implementations of the invention relate generally to a scan driver and a display device having the same.

Discussion of the Background

A display device includes a display panel, a scan driver, a data driver, a timing driver, and the like. The scan driver provides a scan signal to the display panel through scan lines. To this end, the scan driver includes stage circuits for outputting scan signals, which are coupled in sequence, and each of the stage circuits is configured with a plurality of oxide thin film transistors to be operated.

Recently, the display device has performed driving for compensating for degradation or characteristic change of a driving transistor by sensing a threshold voltage or mobility of the driving transistor at the outside a pixel circuit. Scanning methods for a display operation, a mobility sensing operation, and a threshold voltage sensing operation are different from one another. Studies on a scan driver for minimizing the complexity of its circuit while stably performing operations using such various methods and a stage circuit of the scan driver have been conducted.

The above information disclosed in this Background section is only for understanding of the background of the inventive concepts, and, therefore, it may contain information that does not constitute prior art.

SUMMARY

Devices constructed according to exemplary implementations of the invention provide a scan driver for stably outputting a scan signal and/or a sensing signal by controlling a voltage of a first driving node, and also a display device including the scan driver.

Additional features of the inventive concepts will be set forth in the description which follows, and in part will be apparent from the description, or may be learned by practice of the inventive concepts.

According to one or more exemplary embodiments of the invention, a scan driver includes: a plurality of stages configured to respectively transmit scan signals and carry signals, the plurality of stages comprising an n-th stage comprising: a first driving controller configured to control a voltage of a first node and a voltage of a second node in response to a previous carry signal, the previous carry signal being a carry signal transmitted from a stage preceding the n-th stage; a second driving controller configured to: control a voltage of a first driving node, based on a sensing-on signal, a next carry signal, the voltage of a first power source, the voltage of the first node, and a voltage of a sampling node, the next carry signal being a carry signal transmitted from a stage succeeding the n-th stage; and control a voltage of a second driving node, based on the voltage of the sampling node and a sensing clock signal; an output buffer configured to: transmit the carry signal in response to the voltage of the first node and the voltage of the second node; and transmit the scan signal in response to the voltage of the first driving node and the voltage of the second driving node; and a connection controller configured to electrically couple the first node and the first driving node to each other and electrically couple the second node and the second driving node to each other, in response to a display-on signal, wherein n is a natural number.

The second driving controller may include: an eighth transistor coupled between an input terminal to which the next carry signal is applied and the sampling node, the eighth transistor including a gate electrode configured to receive the sensing-on signal; ninth and tenth transistors coupled in series between a clock terminal to which the sensing clock signal is applied and the first driving node, the ninth and tenth transistors including gate electrodes commonly coupled to the sampling node; and an eleventh transistor coupled between a first power terminal to which the first power source is applied and a third node between the ninth and tenth transistors, the eleventh transistor including a gate electrode coupled to the first driving node.

The eleventh transistor may be configured to supply the voltage of the first power source to the third node based on the voltage of the first driving node, in response to the sensing clock signal being supplied.

One frame period may include a display period and a vertical blank period. In the display period, the sensing-on signal may be supplied to the n-th stage that is one of the stages.

The n-th stage may be configured to output the scan signal in the vertical blank period continued to the display period.

The sensing-on signal may be applied in synchronization with the next carry signal in the display period.

The next carry signal may be an (n+3)th carry signal being a carry signal transmitted from an (n+3)th stage.

The second driving controller may further include: a capacitor coupled between a second power terminal to which a second power source is applied and the sampling node; and twelfth and thirteenth transistors coupled in series between a third power terminal to which a third power source is applied and the second driving node. The twelfth transistor may include a gate electrode configured to receive the sensing clock signal, and the thirteenth transistor may include a gate electrode coupled to the sampling node.

The second driving controller may include: an eighth transistor coupled between an input terminal to which an (n+3)th carry signal is applied and the sampling node, the eighth transistor including a gate electrode configured to receive the sensing-on signal; ninth and tenth transistors coupled in series between a clock terminal to which the sensing clock signal is applied and the first driving node, the ninth and tenth transistors including gate electrodes commonly coupled to the sampling node; and an eleventh transistor diode-coupled between a carry output terminal that outputs the carry signal and a third node between the ninth and tenth transistors or between the third node and an output terminal that outputs the scan signal.

The second driving controller may include: an eighth transistor coupled between an input terminal to which the (n+3)th carry signal is applied and the sampling node, the eighth transistor including a gate electrode configured to receive the sensing-on signal; a ninth transistor coupled between a third node and the first driving node, the ninth transistor including a gate electrode configured to receive a first sensing clock signal; a tenth transistor coupled between a clock terminal to which a second sensing clock signal is applied and the third node, the tenth transistor including a gate electrode coupled to the sampling node; and an eleventh transistor coupled between a power terminal to which the first power source is applied and the third node, the eleventh transistor including a gate electrode coupled to the first driving node.

The second driving controller may include: an eighth transistor coupled between an input terminal to which the (n+3)th carry signal is applied and the sampling node, the eighth transistor including a gate electrode configured to receive the sensing-on signal; a ninth transistor coupled between a third node and the first driving node, the ninth transistor including a gate electrode configured to receive a sensing clock signal; a tenth transistor coupled between a clock terminal to which the sensing clock signal is applied and the third node, the tenth transistor including a gate electrode coupled to the sampling node; an eleventh transistor coupled between a power terminal to which the first power source is applied and the third node, the eleventh transistor including a gate electrode coupled to the first driving node; and an additional transistor coupled between the third node and the first driving node, the additional transistor including a gate electrode configured to receive the previous carry signal.

The first driving controller may include: a first transistor coupled between a first power terminal to which the first power source is applied and the first node, the first transistor including a gate electrode configured to receive one of an (n−2)th carry signal or a scan start signal, the (n−2)th carry signal being a carry signal transmitted from an (n−2)th stage; second and third transistors coupled in series between the first node and a carry output terminal that outputs the carry signal; a fourth transistor coupled between the first node and the carry output terminal, the fourth transistor including a gate electrode configured to receive the (n+3)th carry signal; a fifth transistor coupled between a first clock terminal to which a first clock signal is applied and the second node, the fifth transistor including a gate electrode coupled to the first node; a sixth transistor coupled between the first power terminal and the second node, the sixth transistor including a gate electrode coupled to the first clock terminal; and a seventh transistor diode-coupled between the first power terminal and the second node.

The first driving controller may further include a twentieth transistor coupled between the gate electrode of the fifth transistor and the first node, the twentieth transistor including a gate electrode coupled to the first power terminal. The twentieth transistor may be configured to always maintain a turn-on state.

The output buffer may include: a fourteenth transistor coupled between a second clock terminal to which a clock signal is applied and a carry output terminal configured to transmit the carry signal, the fourteenth transistor including a gate electrode coupled to the first node; a fifteenth transistor coupled between the carry output terminal and a second power terminal to which a second power source is applied, the fifteenth transistor including a gate electrode coupled to the second node; a sixteenth transistor coupled between the second clock terminal and a first output terminal, the sixteenth transistor including a gate electrode coupled to the first driving node; and a seventeenth transistor coupled between a third power terminal to which a third power source is applied and the first output terminal, the seventeenth transistor including a gate electrode coupled to the second driving node.

The output buffer may be further configured to transmit a sensing signal in response to the voltage of the first driving node and the voltage of the second driving node.

The output buffer may further include: a twenty-first transistor coupled between a clock terminal to which a sensing output clock signal is applied and a second output terminal, the twenty-first transistor including a gate electrode coupled to the first driving node; and a twenty-second transistor coupled between a third power terminal to which a third power source is applied and the second output terminal, the twenty-second transistor including a gate electrode coupled to the second driving node.

The connection controller may include: an eighteenth transistor coupled between the first node and the first driving node, the eighteenth transistor including a gate electrode configured to receive the display-on signal; and a nineteenth transistor coupled between the second node and the second driving node, the nineteenth transistor including a gate electrode configured to receive the display-on signal.

The connection controller may include: eighteenth transistors coupled in series between the first node and the first driving node, the eighteenth transistors including gate electrodes configured to commonly receive the display-on signal; a nineteenth transistor coupled between the second node and the second driving node, the nineteenth transistor including a gate electrode configured to receive the display-on signal; and a twenty-third transistor coupled between a power terminal to which the first power source is applied and a fourth node between the eighteenth transistors, the twenty-third transistor including a gate electrode coupled to the first driving node.

According to one or more exemplary embodiments of the invention, a display device includes: a plurality of pixels respectively coupled to scan lines, sensing control lines, readout lines, and data lines; a scan driver including a plurality of stages to respectively supply scan signals and sensing signals to the scan lines and the sensing control lines, the plurality of stages comprising an n-th stage; a data driver configured to supply a data signal to the data lines; and a compensator configured to generate a compensation value for compensating for degradation of the pixels, based on sensing values provided from the readout lines.

An n-th (n is a natural number) among the stages may include: a first driving controller configured to control a voltage of a first node and a voltage of a second node in response to a previous carry signal; a second driving controller configured to control a voltage of a first driving node coupled to the first node, based on a sensing-on signal, a next carry signal, the voltage of a first power source, the voltage of the first node, and a voltage of a sampling node, and control a voltage of a second driving node, based on the voltage of the sampling node and a sensing clock signal; an output buffer configured to: transmit a carry signal in response to the voltage of the first node and the voltage of the second node; and transmit at least one of the scan signal and the sensing signal in response to the voltage of the first driving node and the voltage of the second driving node; and a connection controller configured to electrically couple the first node and the first driving node to each other and electrically couple the second node and the second driving node to each other, in response to a display-on signal.

One frame period may include a display period and a vertical blank period. In the display period, the sensing-on signal may be supplied to one of the plurality of stages.

In the display period, a width of the scan signal may be larger than that of the sensing signal.

Data voltages of pixel rows to which an n-th scan signal and an n-th sensing signal are supplied may be supplied in a period in which the n-th scan signal and the n-th sensing signal overlap with each other.

In a mobility sensing period, the width of the scan signal may be smaller than that of the sensing signal.

A sensing voltage may be supplied in the period in which an n-th scan signal and an n-th sensing signal overlap with each other.

The second driving controller may include: an eighth transistor coupled between an input terminal to which the next carry signal is applied and the sampling node, the eighth transistor including a gate electrode configured to receive the sensing-on signal; ninth and tenth transistors coupled in series between a clock terminal to which the sensing clock signal is applied and the first driving node, the ninth and tenth transistors including gate electrodes commonly coupled to the sampling node; and an eleventh transistor coupled between a first power terminal to which the first power source is applied and a third node between the ninth and tenth transistors, the eleventh transistor including a gate electrode coupled to the first driving node.

The sensing-on signal may be applied in synchronization with the next carry signal in the display period.

The next carry signal may be the (n+3)th carry signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
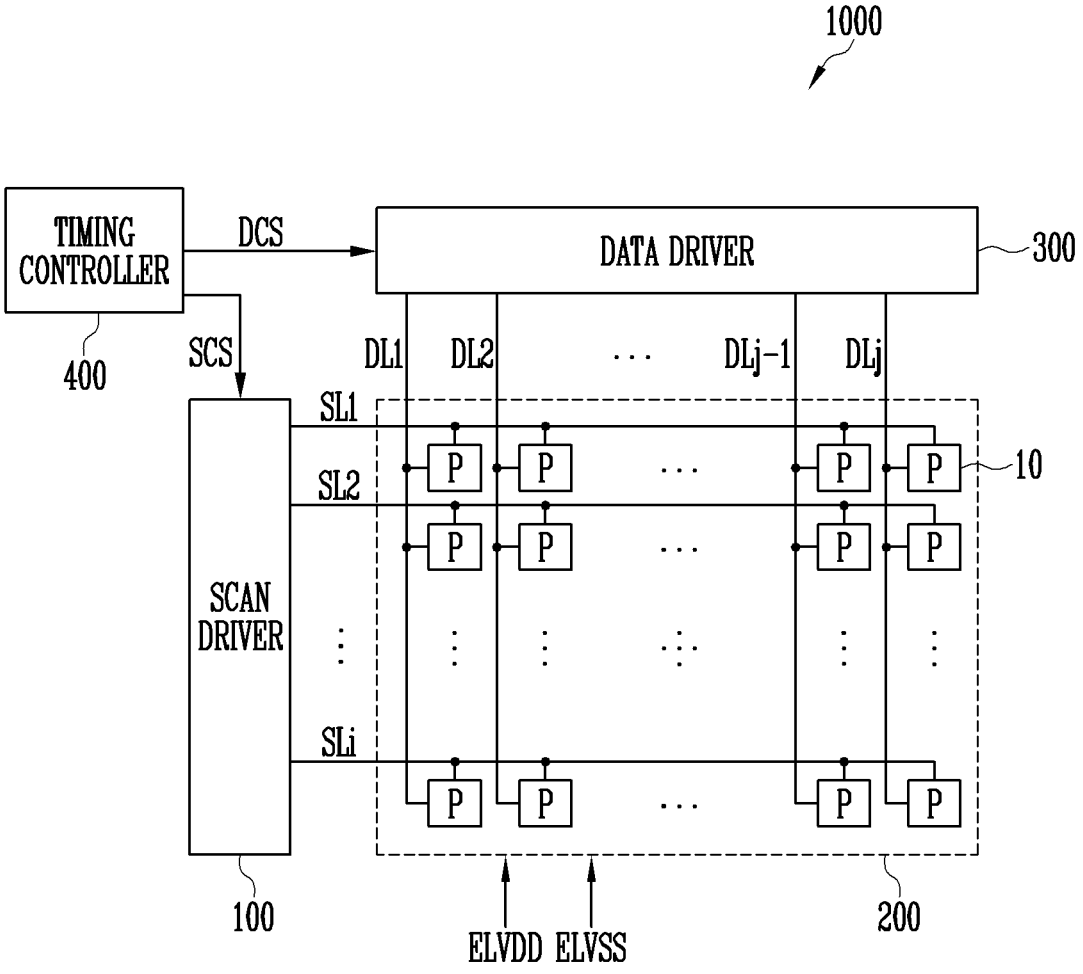
FIG. 1 is a block diagram illustrating a display device according to an exemplary embodiment.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

In the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Various exemplary embodiments are described herein with reference to sectional and/or exploded illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not necessarily be construed as limited to the particular illustrated shapes of regions, but are to include deviations in shapes that result from, for instance, manufacturing. In this manner, regions illustrated in the drawings may be schematic in nature and the shapes of these regions may not reflect actual shapes of regions of a device and, as such, are not necessarily intended to be limiting.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a block diagram illustrating a display device 1000 according to an exemplary embodiment.

Referring to FIG. 1, the display device 1000 may include a scan driver 100, a display panel 200, a data driver 300, and a timing controller 400.

The display device 1000 may be implemented with an organic light emitting display device, a liquid crystal display device, a quantum dot display device, or the like. The display device 1000 may be a flat panel display device, a flexible display device, a curved display device, a foldable display device, or a bendable display device. Also, the display device 1000 may be applied to a transparent display device, a head-mounted display device, a wearable display device, and the like.

The timing controller 400 may generate a data driving control signal DCS and a scan driving control signal SCS, corresponding to synchronization signals supplied from the outside. The data driving control signal DCS generated by the timing controller 400 may be supplied to the data driver 300, and the scan driving control signal SCS generated by the timing controller 400 may be supplied to the scan driver 100.

The data driving control signal DCS may include a source start pulse and clock signals. The source start pulse controls a sampling start time of data. The clock signals may be used to control a sampling operation.

The scan driving control signal SCS may include a scan start signal and clock signals. The scan start signal controls a first timing of a scan signal. The clock signals may be used to shift the scan start signal.

The scan driver 100 may be supplied with the scan driving control signal SCS from the timing controller 400. The scan driver 100 supplied with the scan driving control signal SCS supplies a scan signal to scan lines SL1 to SLi (i is a natural number). In an example, the scan driver 100 may sequentially supply the scan signal to the scan lines SL1 to SLi. When the scan signal is sequentially supplied to the scan lines SL1 to SLi, pixels 10 may be selected in units of horizontal lines. To this end, the scan signal may be set to a gate-on voltage (e.g., a logic high level) such that transistors included in the pixels 10 can be turned on.

The gate-on voltage does not mean one fixed voltage value but may mean a voltage that allows the transistors supplied with the gate-on voltage to be turned on. Therefore, values of gate-on voltages that predetermined input signals have and gate-on voltages charged in a predetermined node may be equal to or different from each other.

The data driver 300 may be supplied with the data driving control signal DCS from the timing controller 400. The data driver 300 supplied with the data driving control signal DCS may supply a data signal to data lines DL1 to DLj (j is a natural number). The data signal supplied to the data lines DL1 to DLj may be supplied to pixels 10 selected by the scan signal. To this end, the data driver 300 may supply the data signal to the data lines DL1 to DLj to be synchronized with the scan signal.

The display panel 200 includes pixels 10 coupled to the scan lines SL1 to SLi and the data lines DL1 to DLj. The display panel 200 may be supplied with a first driving power source ELVDD and a second driving power source ELVSS from the outside.

Meanwhile, although i scan lines SL1 to SLi are illustrated in FIG. 1, the present disclosure is not limited thereto. In an example, one or more scan lines, one or more emission control lines, one or more readout lines, one or more sensing lines, etc. may be additionally formed in the display panel 200, corresponding to the circuit structure of the pixel 10. In an example, one scan signal may be simultaneously supplied to two consecutive pixel lines.

In an exemplary embodiment, transistors included in the display device 1000 may be implemented with an N-type oxide thin film transistor. For example, the oxide thin film transistor may be a Low Temperature Polycrystalline Oxide (LTPO) thin film transistor. However, this is merely illustrative, and N-type transistors are not limited thereto. For example, an active pattern (semiconductor layer) included in each of the transistors may include an inorganic semiconductor (e.g., amorphous silicon) or poly-silicon), an organic semiconductor, or the like.

Figure 2:
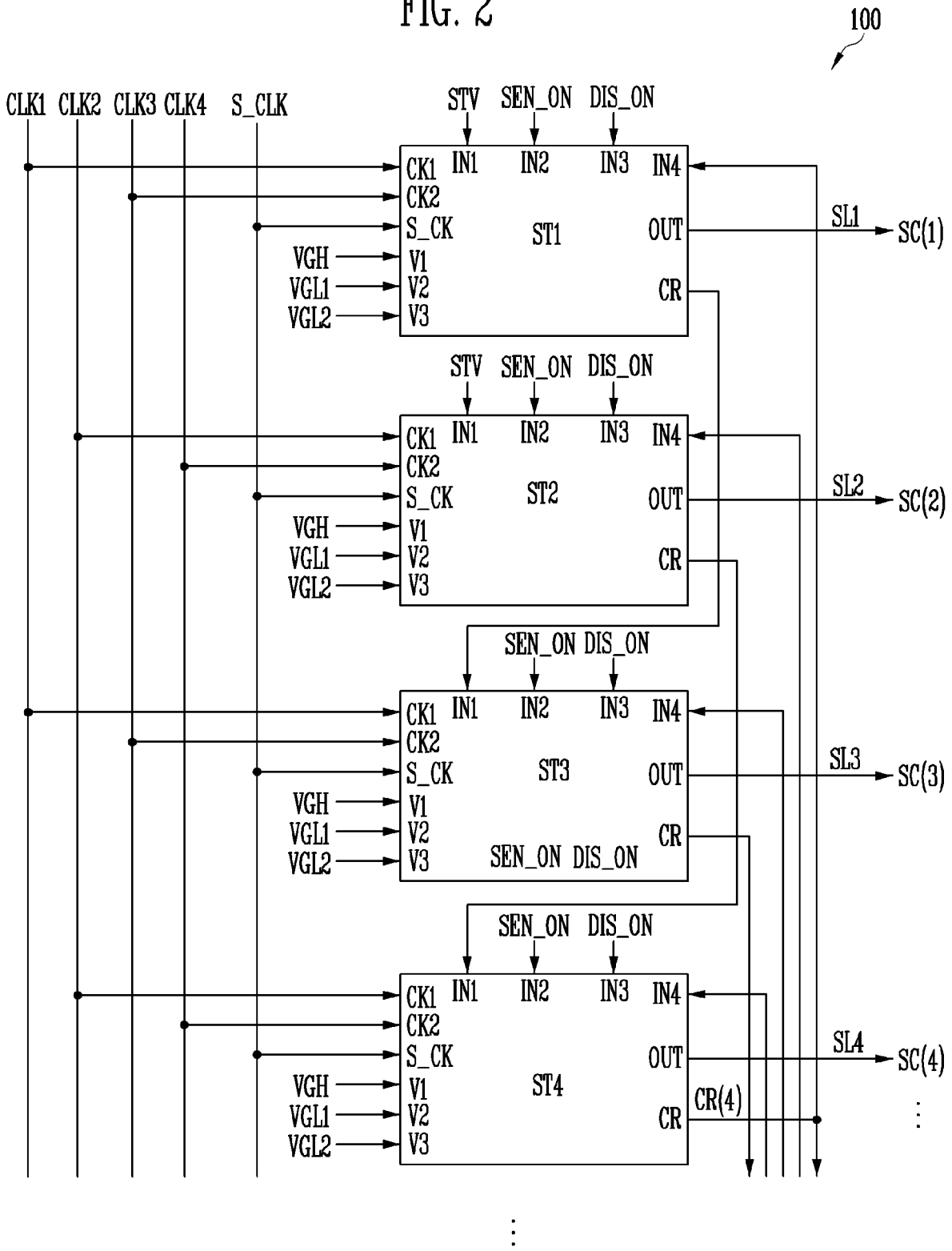
FIG. 2 is a diagram illustrating a scan driver according to an exemplary embodiment.

FIG. 2 is a diagram illustrating a scan driver 100 according to an exemplary embodiment.

Referring to FIG. 2, the scan driver 100 may include a plurality of stages ST1, ST2, ST3, ST4, . . . STi.

The stages ST1, ST2, ST3, ST4, . . . STi may respectively output scan signals SC(1), SC(2), SC(3), SC(4), . . . SC(i) in response to a scan start signal STV. For example, an n-th stage may output n-th scan signal to an n-th scan line. The scan start signal STV for controlling a timing of a first scan signal may be supplied to a first stage ST1.

Each of the stages ST1, ST2, ST3, ST4, . . . STi may include a first input terminal IN1, a second input terminal IN2, a third input terminal IN3, a fourth input terminal IN4, a first clock terminal CK1, a second clock terminal CK2, a sensing clock terminal S_CK, a first power terminal V1, a second power terminal V2, a third power terminal V3, a carry output terminal CR, and an output terminal OUT.

The first input terminal IN1 may receive the scan start signal STV or a previous carry signal. In an exemplary embodiment, the scan start signal STV may be supplied to the first input terminal IN1 of the first stage ST1, and a carry signal of a previous stage may be applied to the first input terminal IN1 of each of the stages except the first stage ST1. In an exemplary embodiment, an (n−2)th carry signal may be applied to the first input terminal IN1 of the n-th stage (n is a natural number that satisfies 3≤n≤i).

The second input terminal IN2 may receive a sensing-on signal SEN_ON. The sensing-on signal SEN_ON is a control signal for outputting a scan signal in a mobility sensing period. For example, a gate-on voltage may be stored in a sampling node included in a stage by the sensing-on signal SEN_ON. In an exemplary embodiment, the mobility sensing period may be included in a vertical blank period.

The third input terminal IN3 may receive a display-on signal DIS_ON. The display-on signal DIS_ON may have a gate-on voltage in a display period, and have a gate-off voltage in the mobility sensing period.

The fourth input terminal IN4 may receive a next carry signal or an extra carry signal. The next carry signal may be one of carry signals supplied after a predetermined time elapses from when a carry signal of a current stage is output. For example, an (m+p)th carry signal may be applied to the fourth input terminal IN4 of the m-th stage, and each extra carry signal may be applied to the fourth input terminal IN4 of the (i−m+1)th to i-th stages (p is a natural number, and m is a natural number that satisfies m≤(i−p)). For example, the scan driver 100 may further include signal generating circuits for generating the extra carry signals. The extra carry signals may respectively correspond to (i+1)th to (i+m)th carry signals applied to the fourth input terminal IN4 of the (i−m+1)th to i-th stages. In an exemplary embodiment, an (m+3)th carry signal may be applied to the fourth input terminal IN4 of the m-th stage. In an exemplary embodiment, an (m+2)th carry signal may be applied to the fourth input terminal IN4 of the m-th stage.

Clock signals having a difference of a half period, e.g., first and third clock signals CLK1 and CLK3 may be applied to the first clock terminal CK1 and the second clock terminal CK2 of the 2q-th stage (q is a natural number that satisfies 2q≤i). Second and fourth clock signals CLK2 and CLK4 that are respectively inverted signals of the first and third clock signals CLK1 and CLK3 may be applied to the first clock terminal CK1 and the second clock terminal CK2 of an (2q−1)th stage.

In an exemplary embodiment, a gate-on voltage period of each of the clock signals CLK1 to CLK4 may correspond to two horizontal periods 2H. In addition, the gate-on voltage period of the first clock signal CLK1 and the gate-on voltage period of the second clock signal CLK2 may overlap with each other during one horizontal period 1H.

However, this is merely illustrative, and the waveform relationship between the clock signals CLK1 to CLK4 is not limited thereto. In addition, the number of clock signals supplied to one stage is not limited thereto.

Each of the first to fourth clock signals CLK1 to CLK4 may be set as a square wave signal in which a logic high level and a logic low level are alternately repeated. The logic high level may correspond to the gate-on voltage, and the logic low level may correspond to the gate-off voltage. For example, the logic high level may be a voltage value of about 10 V to about 30 V, and the logic low level may be a voltage value of about −16 V to about −3 V.

The sensing clock terminal S_CK may receive a sensing clock signal S_CLK. The sensing clock signal S_CLK may have a gate-on voltage in the mobility sensing period, and charge the gate-on voltage in a first driving node.

The first power terminal V1 may receive the voltage of a first power source VGH, the second power terminal V2 may receive the voltage of a second power source VGL1, and the third power terminal V3 may receive the voltage of a third power source VGL2. The first power source VGH may be set to a gate-on voltage. The second and third power sources VGL1 and VGL2 may be set to a gate-off voltage.

In an exemplary embodiment, the second and third power sources VGL1 and VGL2 may be the same. In an exemplary embodiment, a voltage level of the second power source VGL1 may be smaller than that of the third power source VGL2. For example, the second power source VGL1 may be set to about −9 V, and the third power source VGL2 may be set to about −6 V.

The output terminal OUT may output a scan signal. The scan signal may be supplied to a pixel through a scan line corresponding thereto. The carry output terminal CR may output a carry signal.

Figure 3:
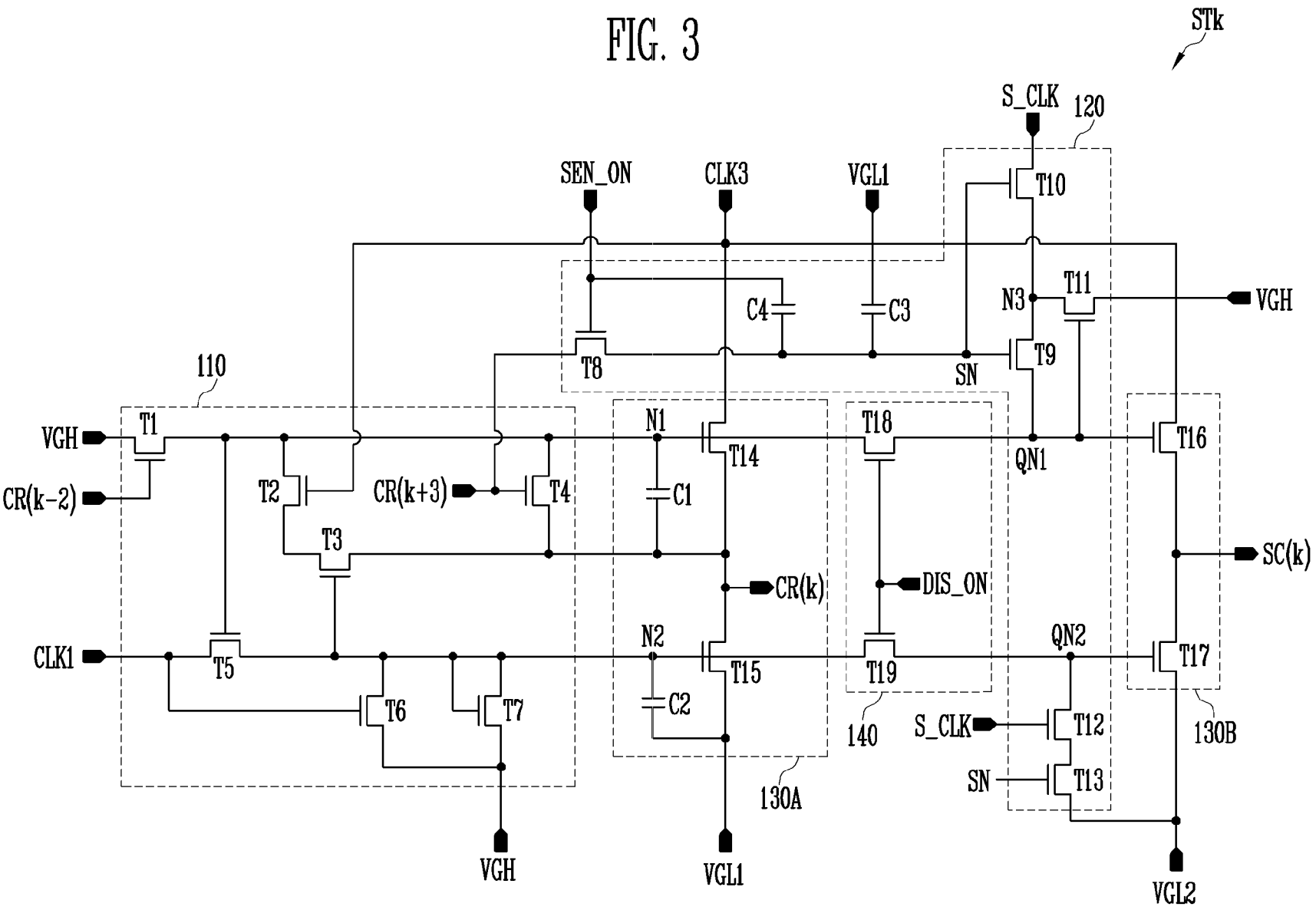
FIG. 3 is a circuit diagram illustrating an example of a stage included in the scan driver shown in FIG. 2.

FIG. 3 is a circuit diagram illustrating an exemplary k-th stage STk included in the scan driver 100 shown in FIG. 2.

Referring to FIGS. 1, 2, and 3, a k-th stage STk (k is a natural number satisfying $3 \leq k \leq (i-3)$) may include a first driving controller 110, a second driving controller 120, output buffers 130A and 130B, and a connection controller 140.

In an exemplary embodiment, transistors included in the k-th stage STk may be oxide semiconductor transistors. That is, semiconductor layers (active patterns) of the transistors may be formed of an oxide semiconductor.

The first driving controller 110 may control a voltage of a first node N1 and a voltage of a second node N2 in response to a previous carry signal CR(k−2). In an exemplary embodiment, the previous carry signal CR(k−2) may be a (k−2)th carry signal CR(k−2). However, this is merely illustrative, and the previous carry signal is not limited to the (k−2)th carry signal CR(k−2). For example, the previous carry signal may be a (k−1)th carry signal.

The output of a k-th carry signal CR(k) may be controlled based on the voltage of the first node N1 and the voltage of the second node N2. For example, the voltage of the first node N1 is a voltage for controlling the output of the k-th carry signal CR(k).

Meanwhile, in an exemplary embodiment, in a display period, a voltage of a first driving node QN1 may be determined by the voltage of the first node N1, and a voltage of a second driving node QN2 may be determined by the voltage of the second node N2. Therefore, in the display period, the output of a k-th scan signal SC(k) may be controlled by the voltage of the first node N1 and the voltage of the second node N2.

In other words, the first driving controller 110 may perform an operation of controlling the output of the carry signal CR(k) and the output of the scan signal SC(k), based on a plurality of input signals in the display period.

In an exemplary embodiment, the first driving controller 110 may include first to fourth transistors T1 to T4 for controlling the voltage of the first node N1 and fifth to seventh transistors T5 to T7 for controlling the voltage of the second node N2.

The first transistor T1 may be coupled between the first power terminal V1 to which the first power source VGH is applied and the first node N1. The first transistor T1 may include a gate electrode that receives the (k−2)th carry signal CR(k−2) or the scan start signal STV. The first transistor T1 may precharge the voltage of the first node N1 to the voltage of the first power source VGH in response to the (k−2)th carry signal CR(k−2). In an exemplary embodiment, the (k−1)th carry signal may be applied to the gate electrode of the first transistor T1.

The second transistor T2 and the third transistor T3 may be coupled between the first node N1 and the carry output terminal CR. The second transistor T2 may include a gate electrode that receives the third clock signal CLK3. The third transistor T3 may include a gate electrode coupled to the second node N2. The second and third transistors T2 and T3 may hold the voltage of the first node N1.

The fourth transistor T4 may be coupled between the first node N1 and the carry output terminal CR. The fourth transistor T4 may include a gate electrode that receives a (k+3)th carry signal CR(k+3). The fourth transistor T4 may discharge the voltage charged in the first node N1. For example, the voltage of the first node N1 may be discharged in synchronization with turn-on of the fourth transistor T4, i.e., a rising time of the (k+3)th carry signal CR(k+3).

The fifth transistor T5 may be coupled between the first clock terminal CK1 to which the first clock signal CLK1 is applied and the second node N2. The fifth transistor T5 may include a gate electrode coupled to the first node N1. The sixth transistor T6 may be coupled between the second node N2 and the first power terminal V1. The sixth transistor T6 may include a gate electrode that receives the first clock signal CLK1. The seventh transistor T7 may be diode-coupled between the first power terminal V1 and the second node N2.

The fifth to seventh transistors T5 to T7 may control the voltage of the second node N2, based on the first clock signal CLK1.

The second driving controller 120 may control a voltage of the first driving node QN1 coupled to the first node N1, based on the sensing-on signal SEN_ON, a next carry signal CR(k+3), the voltage of the first power source VGH, the voltage of the first node N1, and a voltage of a sampling node SN, and control a voltage of the second driving node QN2, based on the voltage of the sampling node SN and the sensing clock signal S_CLK.

The second driving controller 120 may control the voltage of the first driving node QN1 and the voltage of the second driving node QN2 during a sensing period. In the sensing period, the output of the scan signal SC(k) may be controlled by the voltage of the first driving node QN1 and the voltage of the second driving node QN2. In an exemplary embodiment, the sensing period may be a mobility sensing period in which a mobility of a driving transistor included in each pixel is sensed.

In an exemplary embodiment, the second driving controller 120 may include eighth to eleventh transistors T8 to T11 for controlling the voltage of the first driving node QN1 and twelfth and thirteenth transistors T12 and T13 for controlling the voltage of the second driving node QN2. The second driving controller 120 may further include third and fourth capacitors C3 and C4.

The eighth transistor T8 may be coupled between the fourth input terminal IN4 to which a next carry signal is applied and the sampling node SN. The eighth transistor T8 may include a gate electrode that receives the sensing-on signal SEN_ON. In an exemplary embodiment, the next carry signal may be the (k+3)th carry signal CR(k+2). The eighth transistor T8 may charge a gate-on voltage of the (k+3)th carry signal CR(k+3) in the sampling node SN in response to the sensing-on signal SEN_ON. The sensing-on signal SEN_ON may have a gate-on voltage in synchronization with the (k+3)th carry signal CR(k+3).

The third capacitor C3 may be coupled between the second power terminal V2 that receives the second power source VGL1 and the sampling node SN. The gate-on voltage charged in the sampling node SN may be maintained by the third capacitor C3 in response to the sensing-on signal SEN_ON during the display period. The fourth capacitor C4 may be coupled between the gate electrode of the eighth transistor T8 and the sampling node SN.

The ninth transistor T9 and the tenth transistor T10 may be coupled in series between the sensing clock terminal S_CK to which the sensing clock signal S_CLK is applied and the first driving node QN1. A node between the ninth transistor T9 and the tenth transistor T10 may be defined as a third node N3.

The ninth and tenth transistors T9 and T10 may include gate electrodes commonly coupled to the sampling node SN. The ninth and tenth transistors T9 and T10 may transfer the sensing clock signal S_CLK to the first driving node QN1, based on the voltage of the sampling node SN. In an exemplary embodiment, the sensing clock signal S_CLK may have a gate-on voltage in the sensing period (e.g., the mobility sensing period).

The eleventh transistor T11 may be coupled between the third node N3 and the first power terminal V1 to which the first power source VGH is applied. The eleventh transistor T11 may include a gate electrode coupled to the first driving node QN1.

According to the conventional technology, in a display device having a scan driver with similar structure, a voltage of the a driving node may be excessively amplified due to a change of a sensing clock signal applied to a sensing clock signal terminal. Accordingly, a drain-source voltage of a transistor between the sensing clock terminal and the driving node may be considerably increased, and hence current leakage may occur in an output buffer. Therefore, transistors of a second driving controller and the output buffer may be rapidly degraded or broken, and output of the scan signal may not be stable. Accordingly, the reliability of the scan driver 100 and the display device 1000 having the same may be deteriorated.

In comparison, according to the exemplary embodiments, the ninth to eleventh transistors T9 to T11 may hold a voltage of the third node N3 as the voltage of the first power source VGH in response to the voltage of the first driving node QN1, so that an unnecessary drain-source voltage increase of the ninth transistor T9 can be prevented or reduced. Thus, stable output of the scan signal SC(k) can be ensured, and the reliability of the display device 1000 can be improved.

The twelfth transistor T12 and the thirteenth transistor T13 may be coupled in series between the third power terminal V3 to which the third power source VGL2 is applied and the second driving node QN2. The twelfth transistor T12 may include a gate electrode that receives the sensing clock signal S_CLK, and the thirteenth transistor T13 may include a gate electrode coupled to the sampling node SN. In the mobility sensing period, the twelfth and thirteenth transistors T12 and T13 may be turned on, and the voltage of the third power source VGL2 may be applied to the second driving node QN2.

The output buffers 130A and 130B may output the carry signal CR(k) in response to the voltage of the first node N1 and the voltage of the second node N2, and output the scan signal SC(k) in response to the voltage of the first driving node QN1 and the voltage of the second driving node QN2. In an exemplary embodiment, the output buffers 130A and 130B may output the scan signal SC(k) as a sensing signal of a pixel. For example, the scan signal SC(k) and the sensing signal, which are provided to an external compensation pixel, may be respectively output from stages having the substantially same configuration.

The output buffers 130A and 130B may include fourteenth to seventeenth transistors T14 to T17. The output buffers 130A and 130B may further include first and second capacitors C1 and C2.

The fourteenth transistor T14 may be coupled between the second clock terminal CK2 to which the third clock signal CLK3 is applied and the carry output terminal CR. The fourteenth transistor T14 may include a gate electrode coupled to the first node N1. The fourteenth transistor T14 may supply a gate-on voltage to the carry output terminal CR in response to the voltage of the first node N1. For example, the fourteenth transistor T14 may serve as a pull-up buffer.

The fifteenth transistor T15 may be coupled between the carry output terminal CR and the second power terminal V2 to which the second power source VGL1 is applied. The fifteenth transistor T15 may include a gate electrode coupled to the second node N2. The fifteenth transistor T15 may supply a gate-off voltage to the carry output terminal CR in response to the voltage of the second node N2. For example, the fifteenth transistor T15 may maintain a voltage of the carry output terminal CR to a gate-off voltage level (i.e., a logic low level).

The first capacitor C1 may be coupled between the first node N1 and the carry output terminal CR. The first capacitor C1 may serve as a boosting capacitor. Accordingly, the fourteenth transistor T14 can stably maintain a turn-on state during a predetermined period. The second capacitor C2 may be coupled between the second node N2 and the carry output terminal CR.

The sixteenth transistor T16 may be coupled between the second clock terminal CK2 and the output terminal OUT. The sixteenth transistor T16 may include a gate electrode coupled to the first driving node QN1. The sixteenth transistor T16 may supply a gate-on voltage to the output terminal OUT in response to the voltage of the first driving node QN1.

The seventeenth transistor T17 may be coupled between the output terminal OUT and the third power terminal V3 to which the third power source VGL2 is applied. The seventeenth transistor T17 may include a gate electrode coupled to the second driving node QN2. The seventeenth transistor T17 may supply a gate-off voltage to the output terminal OUT in response to the voltage of the second driving node QN2.

In an exemplary embodiment, since the k-th carry signal CR(k) is used as an input signal of another stage, the voltage of the second power source VGL1 may be lower than that of the third power source VGL2 so as to stably output a scan signal.

The connection controller 140 may electrically couple the first node N1 and the first driving node QN1 to each other and electrically couple the second node N2 and the second driving node QN2 to each other, in response to the display-on signal DIS_ON. The display-on signal DIS_ON may have a gate-on voltage in the display period, and have a gate-off voltage in the sensing period (e.g., the mobility sensing period).

In an exemplary embodiment, in the display period, the output buffers 130A and 130B may output the carry signal CR(k) and the scan signal SC(k) through the connection controller 140 according to an operation of the first driving controller 110. That is, in the display period, the second driving controller 120 has no influence on the output of the output buffers 130A and 130B. Similarly, in the mobility sensing period, the output buffers 130A and 130B may output the carry signal CR(k) and the scan signal SC(k)

through the connection controller 140 according to an operation of the second driving controller 120. That is, in the mobility sensing period, the first driving controller 110 has no influence on the output of the output buffers 130A and 130B.

In an exemplary embodiment, the connection controller 140 may include eighteenth and nineteenth transistors T18 and T19.

The eighteenth transistor T18 may be coupled between the first node N1 and the first driving node QN1. The eighteenth transistor T18 may include a gate electrode that receives the display-on signal DIS_ON.

The nineteenth transistor T19 may be coupled between the second node N2 and the second driving node QN2. The nineteenth transistor T19 may include a gate electrode that receives the display-on signal DIS_ON.

As described above, the scan driver 100 according to the exemplary embodiment prevents or reduces an excessive increase in drain-source voltage of the transistors T9 and T10 coupled to the first driving node QN1, so that the scan signal SC(k) can be stably output even in long-time use.

Figure 4:
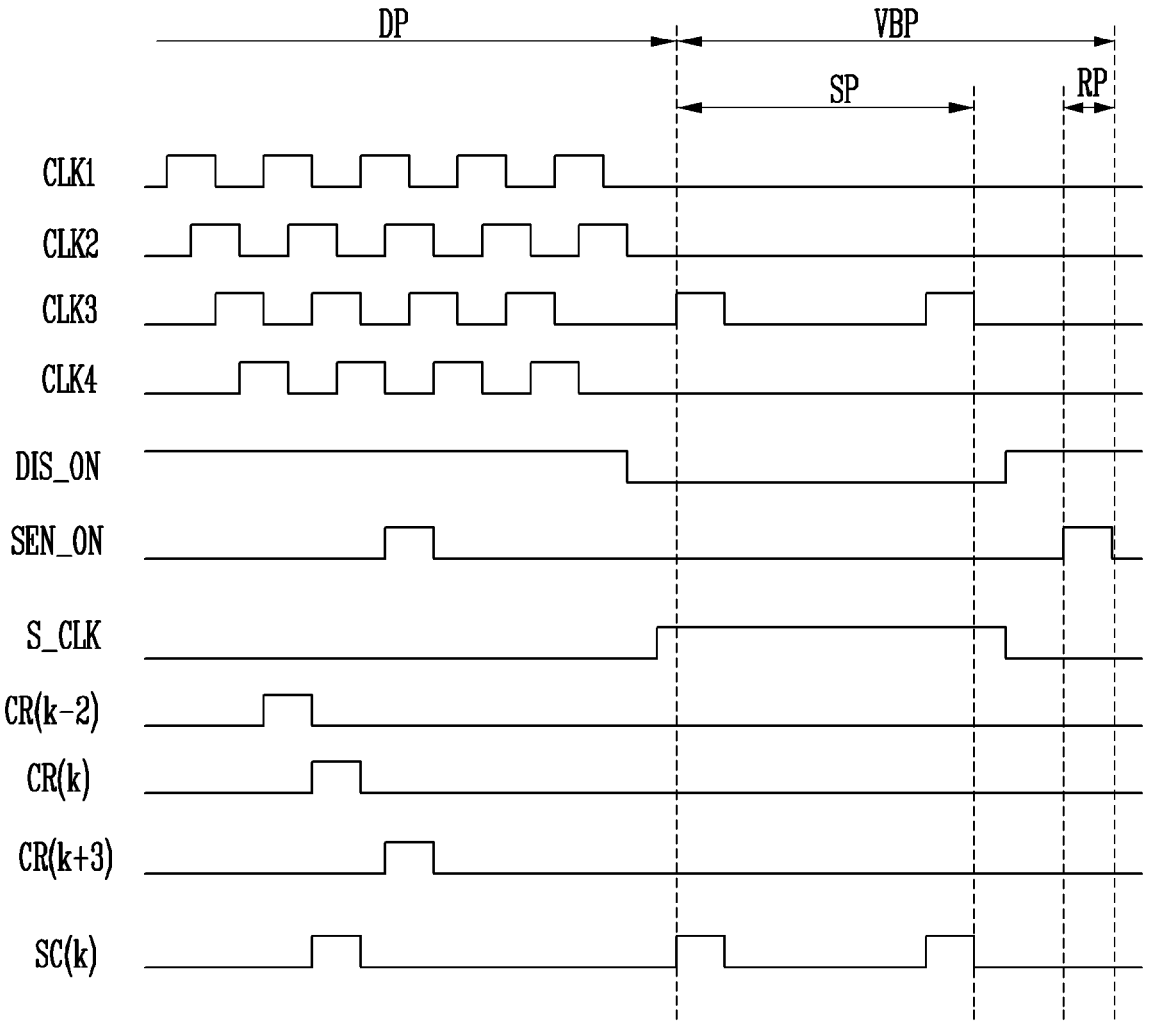
FIG. 4 is a timing diagram illustrating an exemplary operation of the stage shown in FIG. 3.

FIG. 4 is a timing diagram illustrating an exemplary operation of the stage shown in FIG. 3.

Referring to FIGS. 1, 2, 3, and 4, the scan driver 100 including the k-th stage STk may sequentially output a scan signal.

In FIG. 4, an operation of the k-th stage STk will be mainly described. In addition, positions, widths, heights, etc. of waveforms shown in FIG. 4 are merely illustrative, and the present disclosure is not limited thereto.

In an exemplary embodiment, one frame period may include a display period DP and a vertical blank period VBP. In the display period DP, a scan signal may be sequentially provided to pixel lines. In the display period DP, the sensing-on signal SEN_ON may be supplied to only one stage (e.g., the k-th stage) selected among a plurality of stages. Only the stage that receives the sensing-on signal SEN_ON may output the scan signal in a mobility sensing period SP continued to the display period DP.

That is, only one stage among all the stages may output a scan signal in the mobility sensing period SP. Mobility sensing on pixels receiving the output scan signal may be performed during the mobility sensing period SP.

The vertical blank period VBP may include a mobility sensing period SP and a reset period RP. However, this is merely illustrative, and the reset period DP may be included in the display period DP.

In the display period DP, the display-on signal DIS_ON may have a gate-on voltage, and the sensing clock signal S_CLK may have a gate-off voltage. In the mobility sensing period SP, the display-on signal DIS_ON may have a gate-off voltage, and the sensing clock signal S_CLK may have a gate-off voltage.

As shown in FIGS. 2, 3, and 4, when the (k−2)th carry signal CR(k−2) is applied in synchronization with the first clock signal CLK1 applied to the first clock terminal CK1, the voltage of the first node N1 may be precharged. However, this is merely illustrative, and the (k−1)th carry signal CR(k−1) may be applied instead of the (k−2)th carry signal CR(k−2). That is, the voltage of the first node N1 and the voltage of the first driving node QN1 may be precharged before the k-th scan signal SC(k) is output.

Subsequently, when the third clock signal CLK3 has a gate-on voltage, the voltage of the first node N1 and the voltage of the first driving node QN1 may be boosted by the first capacitor C1. In addition, the k-th carry signal CR(k) and the k-th scan signal SC(k) may be output in synchronization with the third clock signal CLK3.

Subsequently, the (k+3)th carry signal CR(k+3) and the sensing-on signal SEN_ON may be simultaneously applied. A stage that receives the sensing-on signal SEN_ON may output a scan signal SC(k) in the subsequent vertical blank period VBP. The voltage of the first node N1 and the voltage of the first driving node QN1 may be discharged in response to the (k+3)th carry signal CR(k+3), and a gate-on voltage may be charged and maintained in the sampling node SN in response to the sensing-on signal SEN_ON.

A clock signal corresponding to the selected stage among the first to fourth clock signals CLK1 to CLK4 may have a gate-on voltage during the mobility sensing period SP in the vertical blank period VBP. For example, as shown in FIG. 4, when a k-th pixel row is sensed in the vertical blank period VBP, a clock signal (e.g., the third clock signal CLK3 in FIGS. 3 and 4) applied to the second clock terminal CK2 of a stage corresponding to the k-th pixel row may have a gate-on voltage in synchronization with the k-th scan signal SC(k).

However, this is merely illustrative, the first to fourth clock signals CLK1 to CLK4 may simultaneously have a gate-on voltage in the mobility sensing period SP.

When the sensing clock signal S_CLK has a gate on voltage and the display-on signal DIS_ON has a gate-off voltage, the voltage of the first driving node QN1 may be charged by the sensing clock signal S_CLK.

Subsequently, the k-th stage STk may output the scan signal SC(k) in synchronization with the third clock signal CLK3 applied to the second clock terminal CK2. In an exemplary embodiment, the scan signal SC(k) may be output twice in the mobility sensing period SP. A voltage for sensing may be applied to a pixel when a first scan signal SC(k) is output, and a data voltage that was applied to the corresponding pixel in a previous display period DP may be re-applied when a second scan signal SC(k) is output.

Subsequently, in the reset period RP, the sensing-on voltage SEN_ON may have a gate-on voltage. Since the (k+3)th carry signal CR(k+3) has a gate-off voltage, the voltage of the sampling node SN may be reset.

Figure 5:
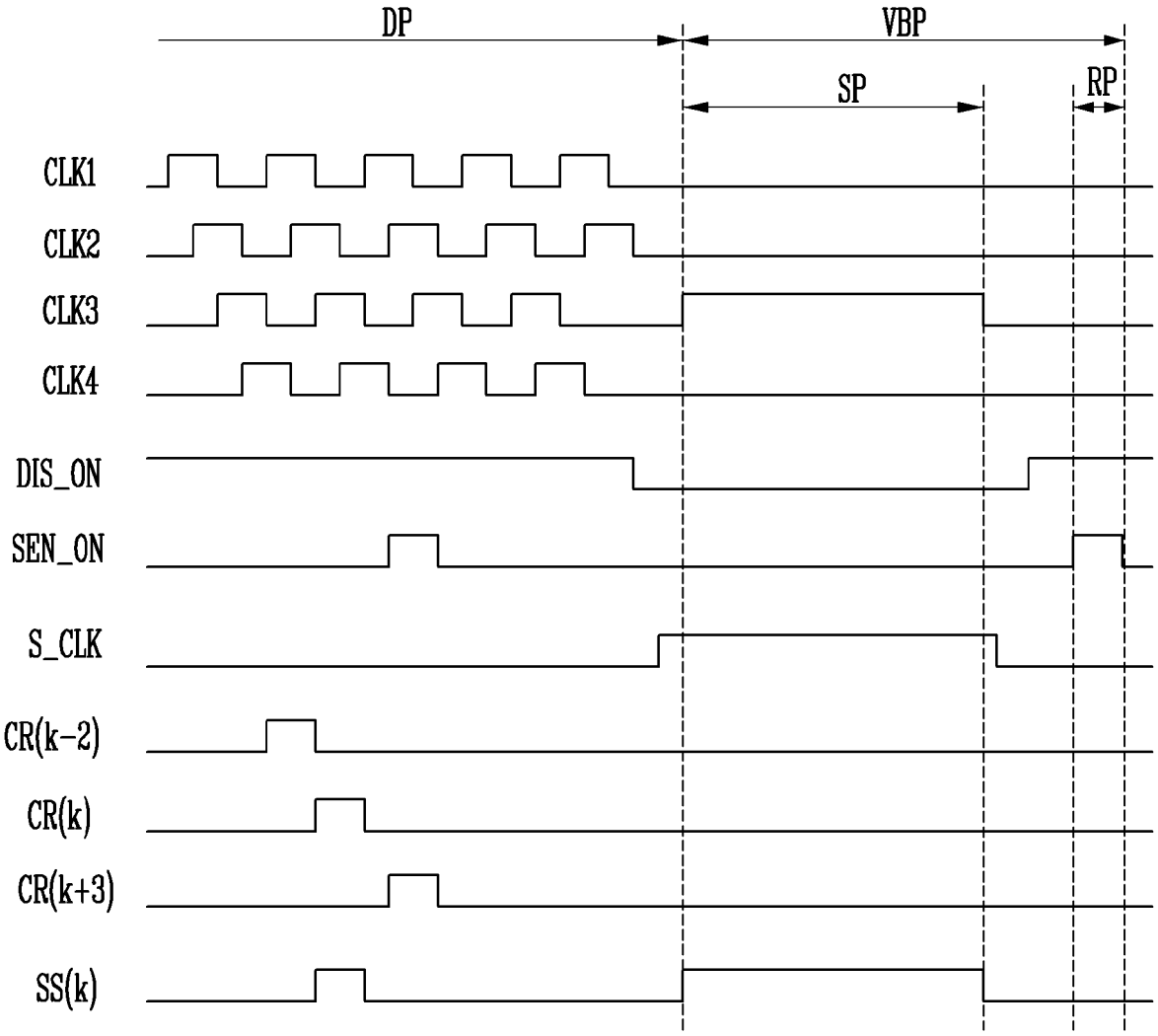
FIG. 5 is a timing diagram illustrating an exemplary operation of the stage shown in FIG. 3.

FIG. 5 is a timing diagram illustrating an exemplary operation of the stage shown in FIG. 3.

FIG. 5 illustrates an example in which the k-th stage STk outputs a k-th sensing signal SS(k) instead of a k-th scan signal SC(k). That is, the scan driver including the k-th stage STk may be a sensing scan driver for outputting a sensing signal.

During a display period DP, the k-th sensing signal SS(k) may be output at the same timing as the k-th scan signal SC(k). An operation of the scan driver in the display period is identical to that of the sensing scan driver in the display period, and therefore, overlapping descriptions will be omitted.

In the display period DP, the display-on signal DIS_ON may have a gate-on voltage, and the sensing clock signal S_CLK may have a gate-off signal. In a mobility sensing period SP, the display-on signal DIS_ON may have a gate-off voltage, and the sensing clock signal S_CLK may have a gate-off signal.

Referring to FIG. 5, a vertical blank period VBP may include the mobility sensing period SP and a reset period RP.

In an exemplary embodiment, a clock signal corresponding to the selected stage among the first to fourth clock signals CLK1 to CLK4 may have a gate-on voltage during the mobility sensing period SP in the vertical blank period VBP. For example, as shown in FIG. 5, when a k-th pixel row is sensed in the vertical blank period VBP, a clock signal applied to the second clock terminal CK2 of a stage corresponding to the k-th pixel row may have a gate-on voltage in synchronization with the k-th sensing signal SS(k).

In an exemplary embodiment, the first to fourth clock signals CLK1 to CLK4 provided to the sensing scan driver during the mobility sensing period SP may all maintain a gate-on voltage. Accordingly, the sensing signal SS(k) may maintain a gate-on voltage during the mobility sensing period SP.

Subsequently, the sensing-on voltage SEN_ON may have a gate-on voltage in the reset period RP. Since the (k+3)th carry signal CR(k+3) has a gate-off voltage, the voltage of the sampling node SN may be reset.

Figure 6A:
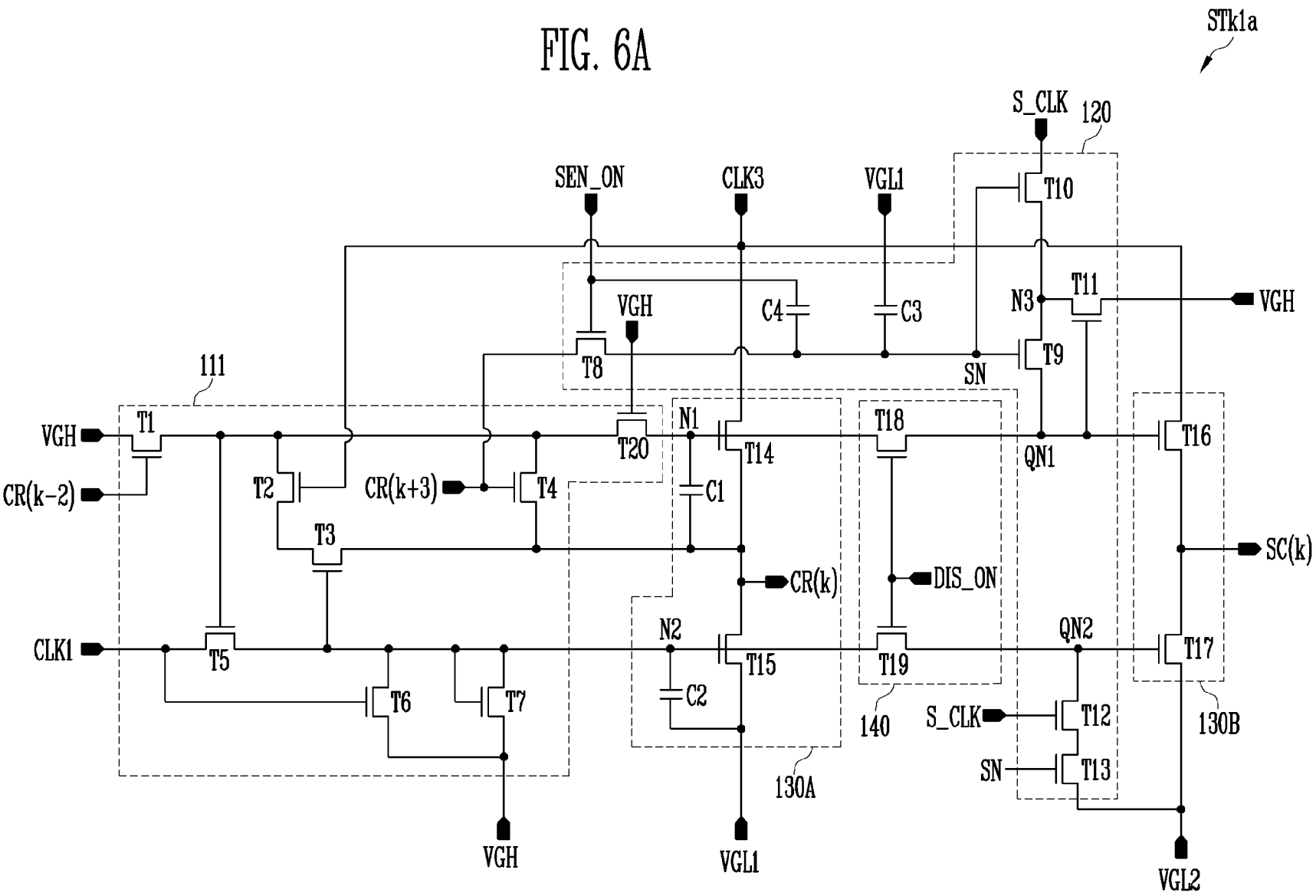
FIG. 6A is a circuit diagram illustrating an exemplary stage included in the scan driver shown in FIG. 2.
Figure 6B:
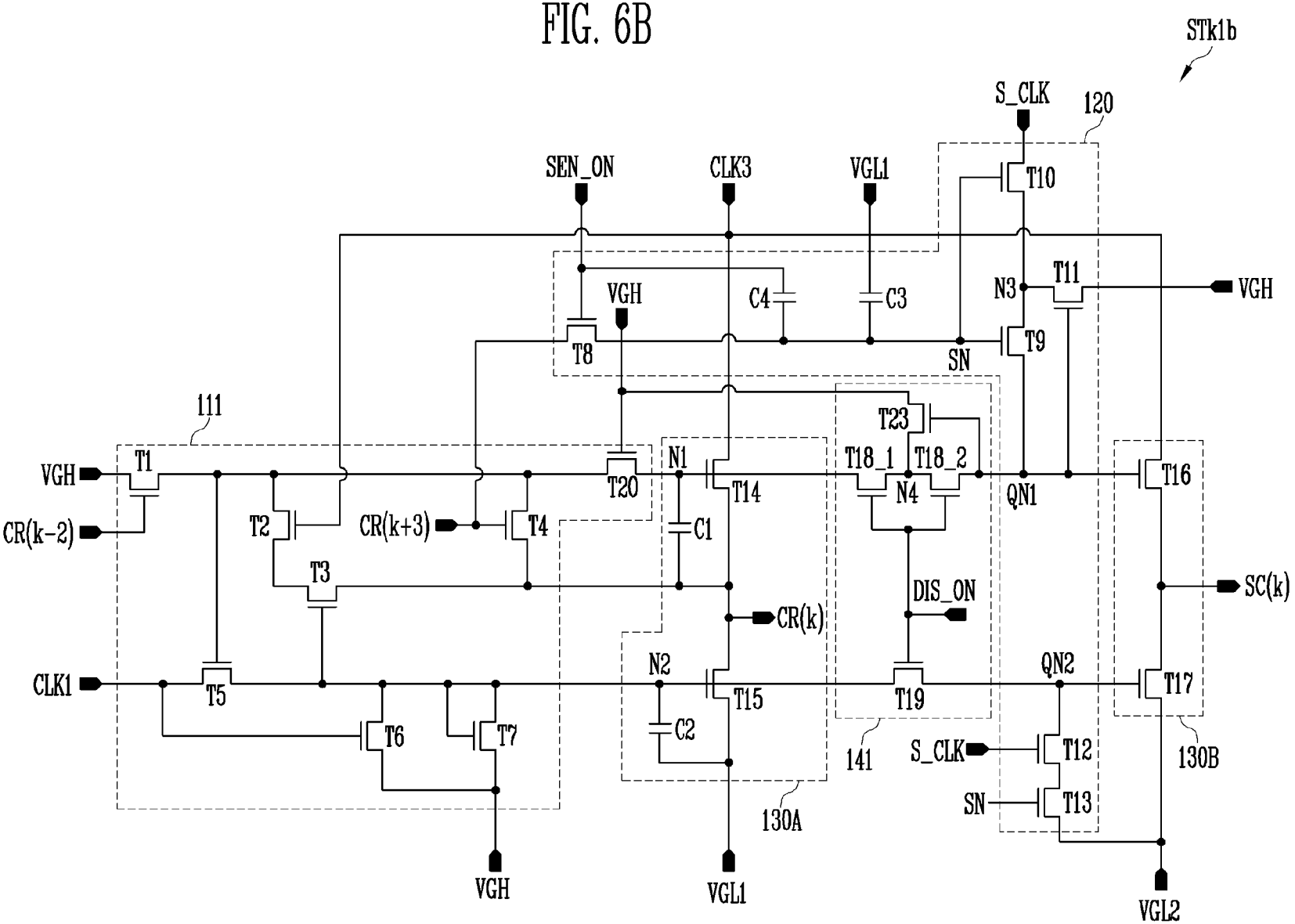
FIG. 6B is a circuit diagram illustrating an exemplary stage included in the scan driver shown in FIG. 2.

FIGS. 6A and 6B are circuit diagrams illustrating examples of the stage included in the scan driver shown in FIG. 2.

In FIGS. 6A and 6B, components identical to those described with reference to FIG. 3 are designated by like reference numerals, and their overlapping descriptions will be omitted. In addition, a k-th stage STk1*a* shown in FIG. 6A may have a configuration substantially identical or similar to that of the k-th stage STk shown in FIG. 3, except the configuration of a first driving controller 111. A k-th stage STk1*b* shown in FIG. 6B may have a configuration substantially identical or similar to that of the k-th stage STk1*a* shown in FIG. 6A, except the configuration of a connection controller 141.

Referring to FIGS. 2, 3, 6A, and 6B, the k-th stages STk1*a* and STk1*b* may include a first driving controller 111, a second driving controller 120, output buffers 130A and 130B. The k-th stage STk1*a* includes a connection controller 140, and the k-th stage STk1*b* includes a connection controller 141.

The first driving controller 111 may control a voltage of a first node N1 and a voltage of a second node N2 in response to a previous carry signal CR(k−2).

In an exemplary embodiment, the first driving controller 111 may further include a twentieth transistor T20. The twentieth transistor T20 may be coupled between a gate electrode of a fifth transistor T5 and the first node N1. A gate electrode of the twentieth transistor T20 may be coupled to the first power terminal V1 that receives the first power source VGH.

Accordingly, the twentieth transistor T20 can always maintain the turn-on state due to the voltage of the first power source VGH. Thus, the twentieth transistor T20 does not have great influence on an operation of the first node N1 and/or an operation of a first driving node QN1.

The twentieth transistor T20 may stabilize a gate voltage of the fifth transistor T5. For example, when the voltage of the first node N1 is boosted by a first capacitor C1, the boosted voltage has no influence on the gate voltage of the fifth transistor T5 due to the twentieth transistor T20. Thus, when the fifth transistor T5 is turned on, a gate-source voltage Vgs of the fifth transistor T5 can be prevented or suppressed from being unintentionally increased, and the fifth transistor T5 can be stably operated.

Accordingly, the reliability of the scan driver 100 can be improved.

The connection controller 140 or 141 may electrically couple the first node N1 and the first driving node QN1 to each other and electrically couple the second node N2 and a second driving node QN2 to each other, in response to the display-on signal DIS_ON.

In an exemplary embodiment, as shown in FIG. 6B, the connection controller 141 may include a plurality of eighteenth transistors T18_1 and T18_2 coupled in series, a nineteenth transistor T19, and a twenty-third transistor T23.

The eighteenth transistors T18_1 and T18_2 may be coupled in series between the first node N1 and the first driving node QN1. Gate electrodes of the eighteenth transistors T18_1 and T18_2 may commonly receive the display-on signal DIS_ON.

The nineteenth transistor T19 may be coupled between the second node N2 and the second driving node QN2. The nineteenth transistor T19 may include a gate electrode that receives the display-on signal DIS_ON.

The twenty-third transistor T23 may be coupled between a power terminal to which the first power source VGH is applied and a fourth node N4 between the eighteenth transistors T18_1 and T18_2. A gate electrode of the twenty-third transistor T23 may be coupled to the first driving node QN1.

The twenty-third transistor T23 holds a voltage of the fourth node N4 as the voltage of the first power source VGH in response to a voltage of the first driving node QN1. Thus, loss between the first node N1 and the first driving node QN1 can be reduced, and an unnecessary increase (degradation) in drain-source voltage can be prevented or reduced. Accordingly, the stable output of a scan signal SC(k) can be ensured, and the reliability of the display device 1000 can be improved.

Figure 7:
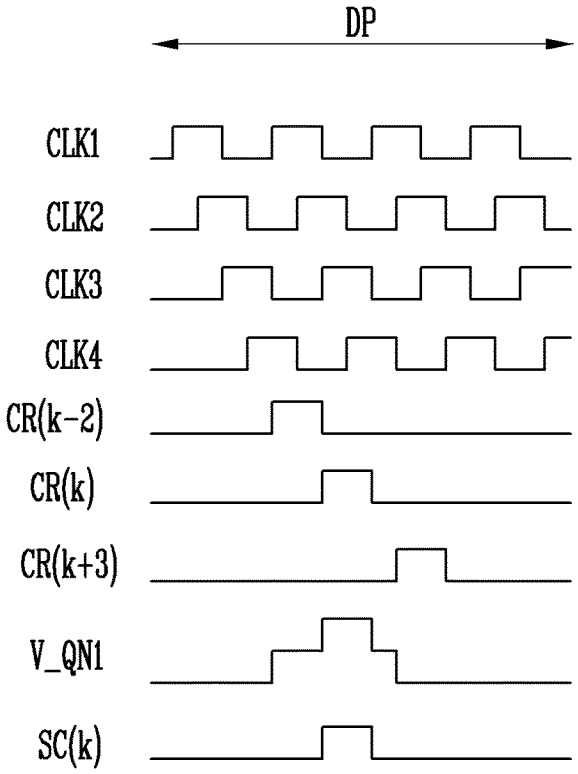
FIGS. 7 and 8 are timing diagrams illustrating examples of an operation of the stage included in the scan driver shown in FIG. 2.
Figure 8:
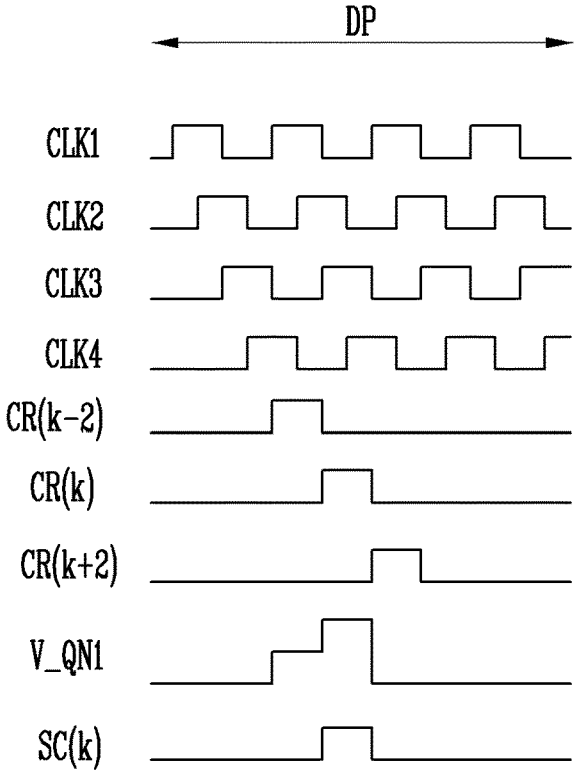

FIGS. 7 and 8 are timing diagrams illustrating examples of an operation of the stage included in the scan driver shown in FIG. 2.

Referring to FIGS. 2, 3, 7, and 8, a voltage V_QN1 of the first driving node QN1 may be changed depending on a next carry signal applied to the k-th stage STk.

FIGS. 7 and 8 illustrate the voltage V_QN1 of the first driving node QN1 in a display period DP.

As shown in FIG. 7, when the (k−2)th carry signal CR(k−2) is applied to the k-th stage STk, the voltage V_QN1 of the first driving node QN1 may be precharged. Subsequently, the voltage V_QN1 of the first driving node QN1 may be boosted during two horizontal periods 2H in synchronization with the third clock signal CLK3, and the k-th carry signal CR(k) and the k-th scan signal SC(k) may be output.

Subsequently, the voltage V_QN1 of the first driving node QN1 may be partially discharged during one horizontal period 1H when the boosting is ended.

Subsequently, the voltage V_QN1 of the first driving node QN1 may be completely discharged in response to the input of the (k+3)th carry signal CR(k+3).

As described above, the voltage V_QN1 of the first driving node QN1 in the k-th stage STk is discharged by the (k+3)th carry signal CR(k+3), and thus the number and complexity of lines for transferring carry signals can be reduced.

However, this is merely illustrative, and the (k+2)th carry signal CR(k+2) instead of the (k+3)th carry signal CR(k+3) may be applied to the k-th stage STk. As shown in FIG. 8, the boosted voltage V_QN1 of the first driving node QN1 may be completely discharged in response to the (k+2)th carry signal CR(k+2).

Figure 9:
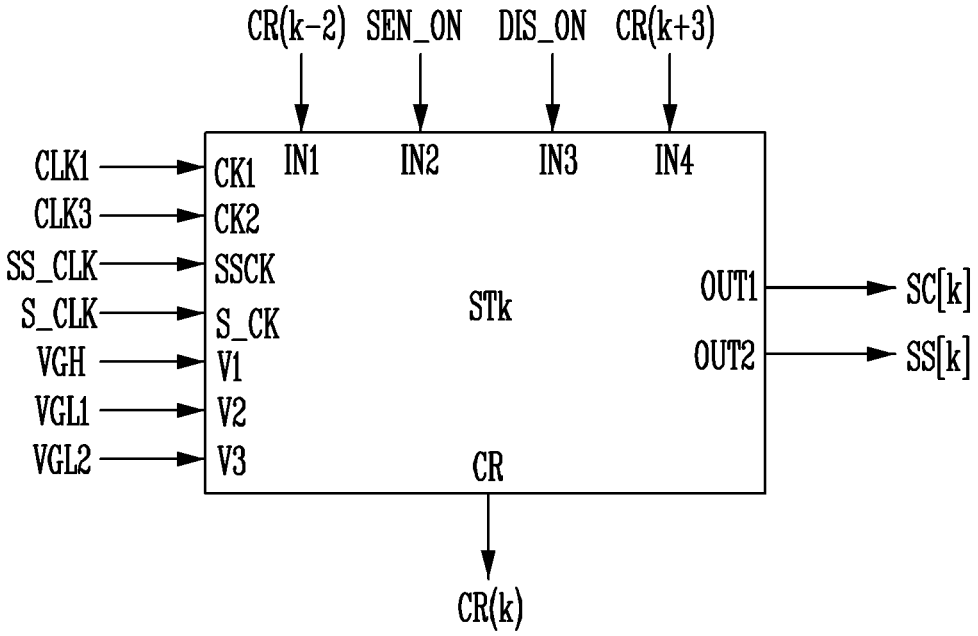
FIG. 9 is a diagram illustrating an exemplary stage included in the scan driver shown in FIG. 2.

FIG. 9 is a diagram illustrating an exemplary stage included in the scan driver shown in FIG. 2.

In FIG. 9, components identical to those described with reference to FIG. 2 are designated by like reference numerals, and their overlapping descriptions will be omitted. In addition, terminals of the stage shown in FIG. 9 may have a configuration substantially identical or similar to that of the terminals of the stage shown in FIG. 2, except clock terminal and output terminals.

Referring to FIGS. 2 and 9, the stage STk may include a first input terminal IN1, a second input terminal IN2, a third input terminal IN3, a fourth input terminal IN4, a first clock terminal CK1, a second clock terminal CK2, a sensing clock terminal S_CK, a sensing output clock terminal SSCK, a first power terminal V1, a second power terminal V2, a third power terminal V3, a carry output terminal CR, a first output terminal OUT1, and a second output terminal OUT2.

The first input terminal IN1 may receive the scan start signal STV and a previous carry signal. The second input terminal IN2 may receive a sensing-on signal SEN_ON. The third input terminal IN3 may receive a display-on signal DIS_ON. The fourth input terminal IN4 may receive a next carry signal.

The first power terminal V1 may receive the voltage of a first power source VGH, the second power terminal V2 may receive the voltage of a second power source VGL1, and the third power terminal V3 may receive the voltage of a third power source VGL2.

The first clock terminal CK1 may receive a first clock signal CLK1 or a second clock signal CLK2. The second clock terminal CK2 may receive a third clock signal CLK3 or a fourth clock signal CLK4. The sensing clock terminal S_CK may receive a sensing clock signal S_CLK.

The sensing output clock terminal SSCK may receive a sensing control clock signal SS_CLK. The sensing control clock signal SS_CLK may have a gate-on voltage synchronized with the output of a sensing signal SS(k).

The carry output terminal CR may output a carry signal. The first output terminal OUT1 may output a scan signal SC(k). The second output terminal OUT2 may output the sensing signal SS(k).

Figure 10:
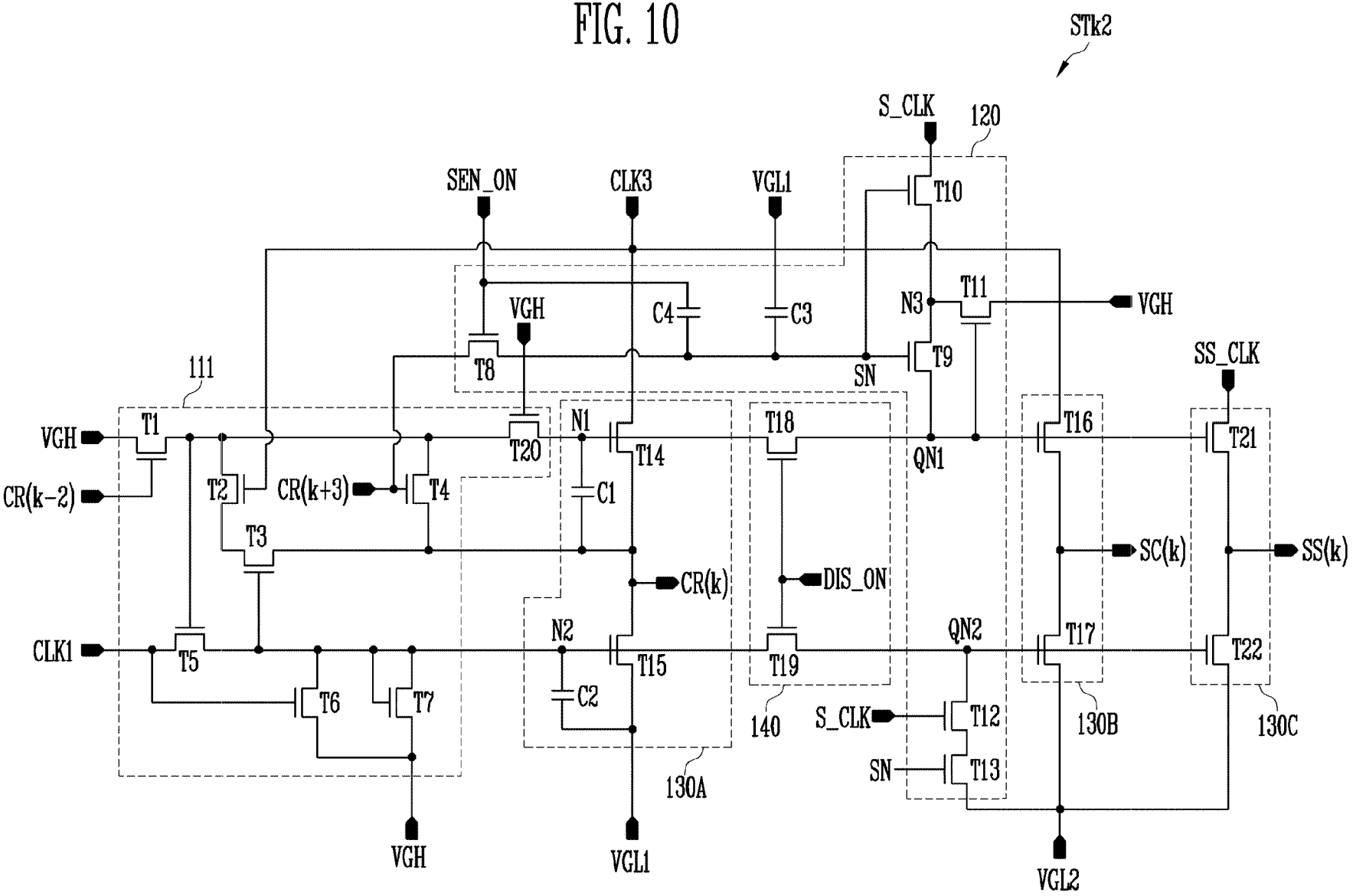
FIG. 10 is a circuit diagram illustrating an exemplary stage shown in FIG. 9.
Figure 11:
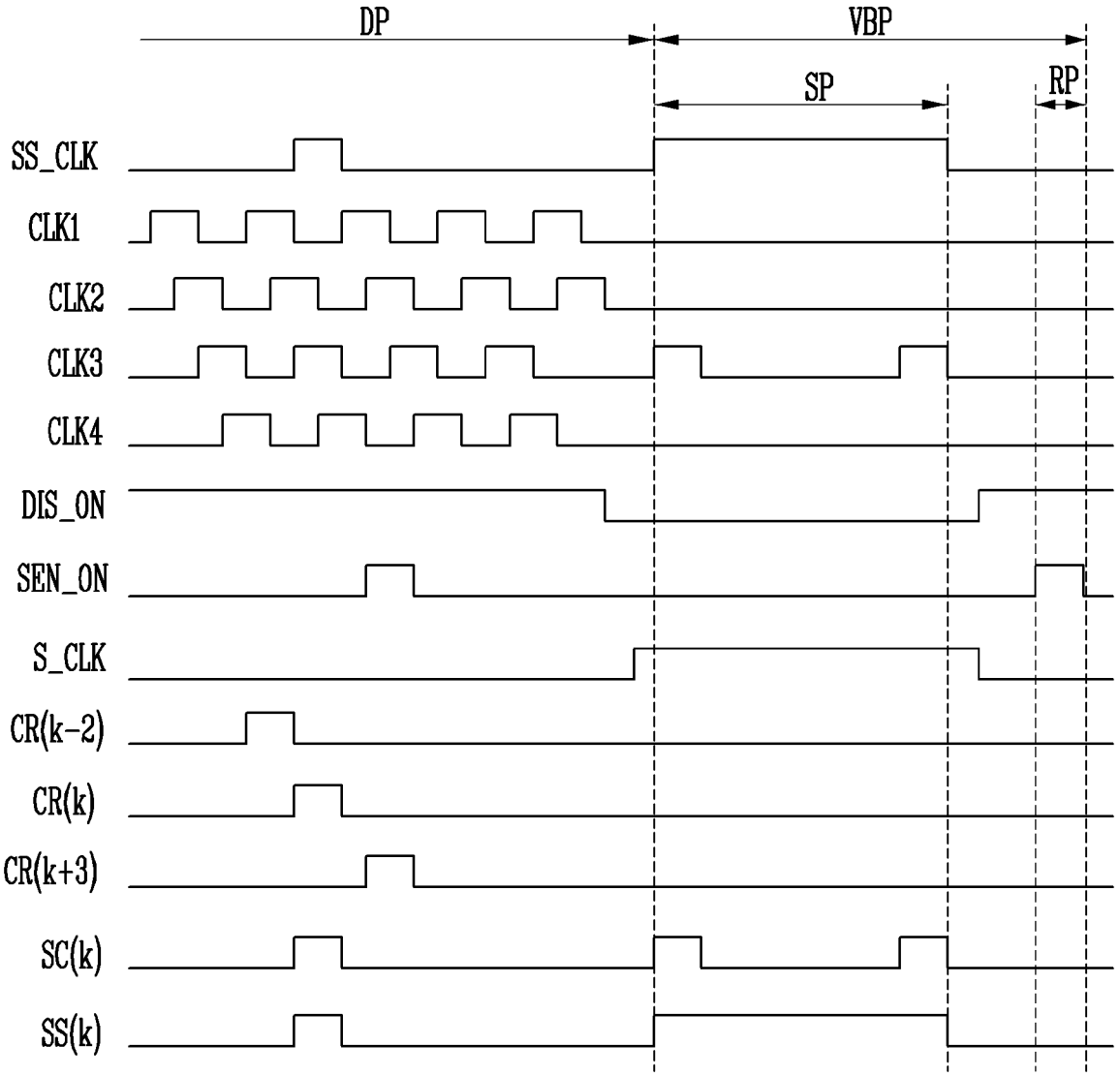
FIG. 11 is a timing diagram illustrating an exemplary operation of the stage shown in FIG. 10.

FIG. 10 is a circuit diagram illustrating an exemplary stage shown in FIG. 9. FIG. 11 is a timing diagram illustrating an exemplary operation of the stage shown in FIG. 10.

In FIG. 10, components identical to those described with reference to FIGS. 3 and 6 are designated by like reference numerals, and their overlapping descriptions will be omitted. In addition, the stage shown in FIG. 10 may have a configuration substantially identical or similar to that of the stage STk1*a* shown in FIG. 6, except the configuration of an output buffer 130C.

Referring to FIGS. 3, 4, 5, 6, 10, and 11, a k-th stage STk2 may include a first driving controller 111, a second driving controller 120, output buffers 130A, 130B, and 130C, and a connection controller 140.

The stage STk2 may output both a scan signal SC(k) and a sensing signal SS(k), which are applied to the same pixel.

In an exemplary embodiment, the output buffers 130A, 130B, and 130C may further include twenty-first and twenty-second transistors T21 and T22 for outputting a sensing signal.

The twenty-first transistor T21 may be coupled between the sensing output clock terminal SSCK to which the sensing output clock signal SS_CLK is applied and the second output terminal OUT2. The twenty-first transistor T21 may include a gate electrode coupled to a first driving node QN1. The twenty-first transistor T21 may supply a gate-on voltage to the second output terminal OUT2 in response to a voltage of the first driving node QN1. For example, the twenty-first transistor T21 may serve as a pull-up buffer.

The twenty-second transistor T22 may be coupled between the third power terminal V3 and the second output terminal OUT2. The twenty-second transistor T22 may include a gate electrode coupled to a second driving node QN2. The twenty-second transistor T22 may supply a gate-off voltage to the second output terminal OUT2 in response to a voltage of the second driving node QN2.

As shown in FIG. 11, the k-th scan signal SC(k) may be output based on the third clock signal CLK3, and the k-th sensing signal SS(k) may be output based on the sensing output clock signal SS_CLK. Accordingly, one k-th stage STk2 may output the output signals of the stages shown in FIGS. 4 and 5 by adding two transistors T21 and T22 and one clock signal SS_CLK. Thus, the circuit configuration of the display device can be simplified.

Figure 12:
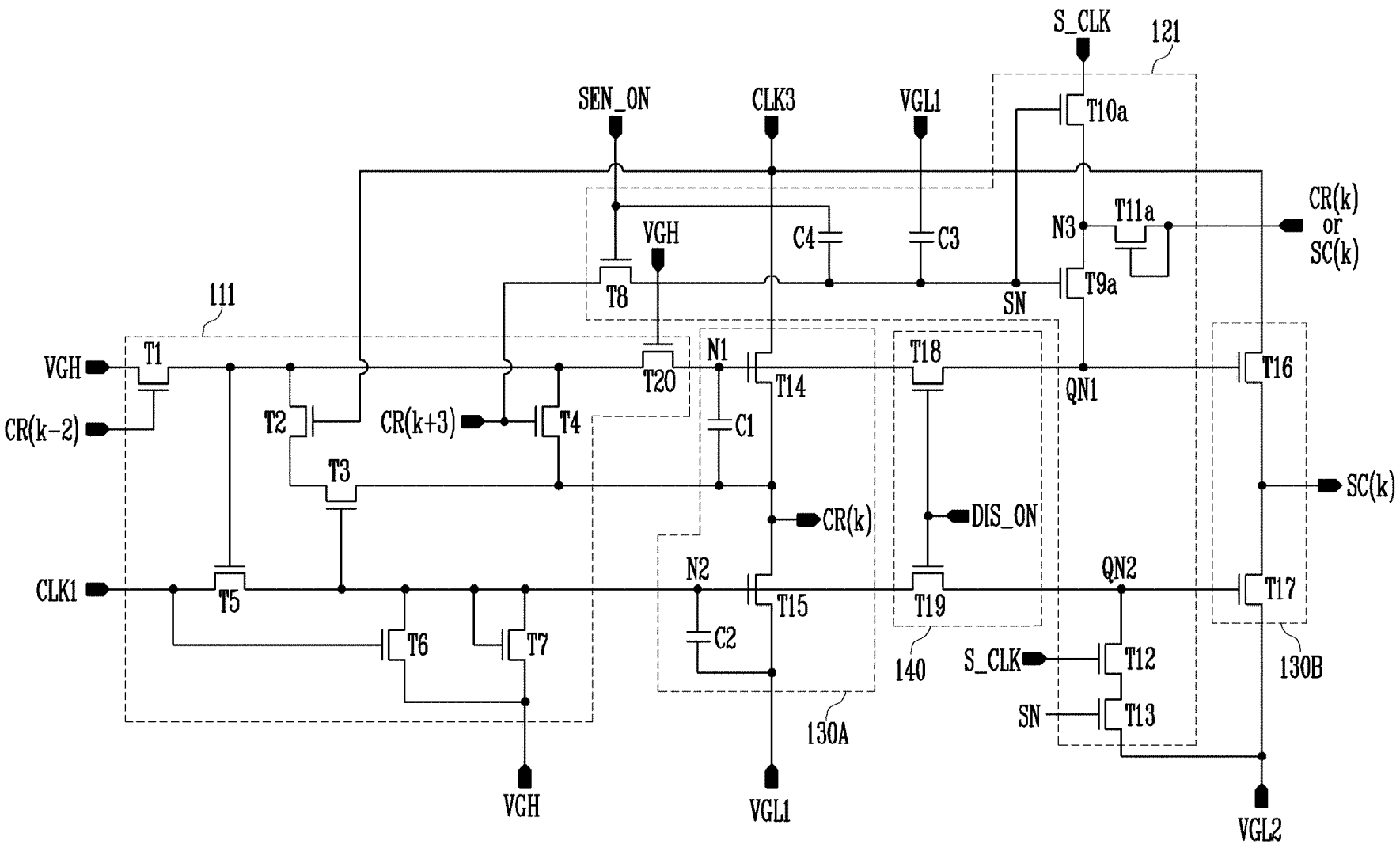
FIG. 12 is a circuit diagram illustrating an exemplary stage included in the scan driver shown in FIG. 2.

FIG. 12 is a circuit diagram illustrating an exemplary stage included in the scan driver shown in FIG. 2.

In FIG. 12, components identical to those described with reference to FIGS. 3 and 6 are designated by like reference numerals, and their overlapping descriptions will be omitted. In addition, the stage shown in FIG. 12 may have a configuration substantially identical or similar to that of the stage STk1*a* shown in FIG. 6, except the configuration of a second driving controller 121.

Referring to FIGS. 3, 6, and 12, a k-th stage may include a first driving controller 111, a second driving controller 121, output buffers 130A and 130B, and a connection controller 140.

The second driving controller 121 may control a voltage of a first driving node QN1.

The second driving controller 121 may include a ninth transistor T9*a*, a tenth transistor T10*a*, and an eleventh transistor T11*a*.

The ninth transistor T9*a* and the tenth transistor T10*a* may be coupled in series between the sensing clock terminal S_CK to which the sensing clock signal S_CLK is applied and the first driving node QN1. Gate electrodes of the ninth and tenth transistors T9*a* and T10*a* may be commonly coupled to a sampling node SN.

The eleventh transistor T11*a* may be diode-coupled between a third node N3 and the carry output terminal CR that outputs a carry signal CR(k) or between the third node N3 and the output terminal OUT that outputs a scan signal SC(k). Therefore, the eleventh transistor T11*a* may transfer the carry signal CR(k) or the scan signal SC(k) to the third node N3 in response to the carry signal CR(k) or the scan signal SC(k). That is, the ninth to eleventh transistors T9*a*, T10*a*, and T11*a* hold a voltage of the third node N3 as a predetermined voltage in response to the carry signal CR(k) or the scan signal SC(k), so that an unnecessary drain-source voltage increase of the ninth transistor T9 can be prevented or reduced. Thus, the stable output of the scan signal SC(k) can be ensured, and the reliability of the display device can be improved.

Figure 13A:
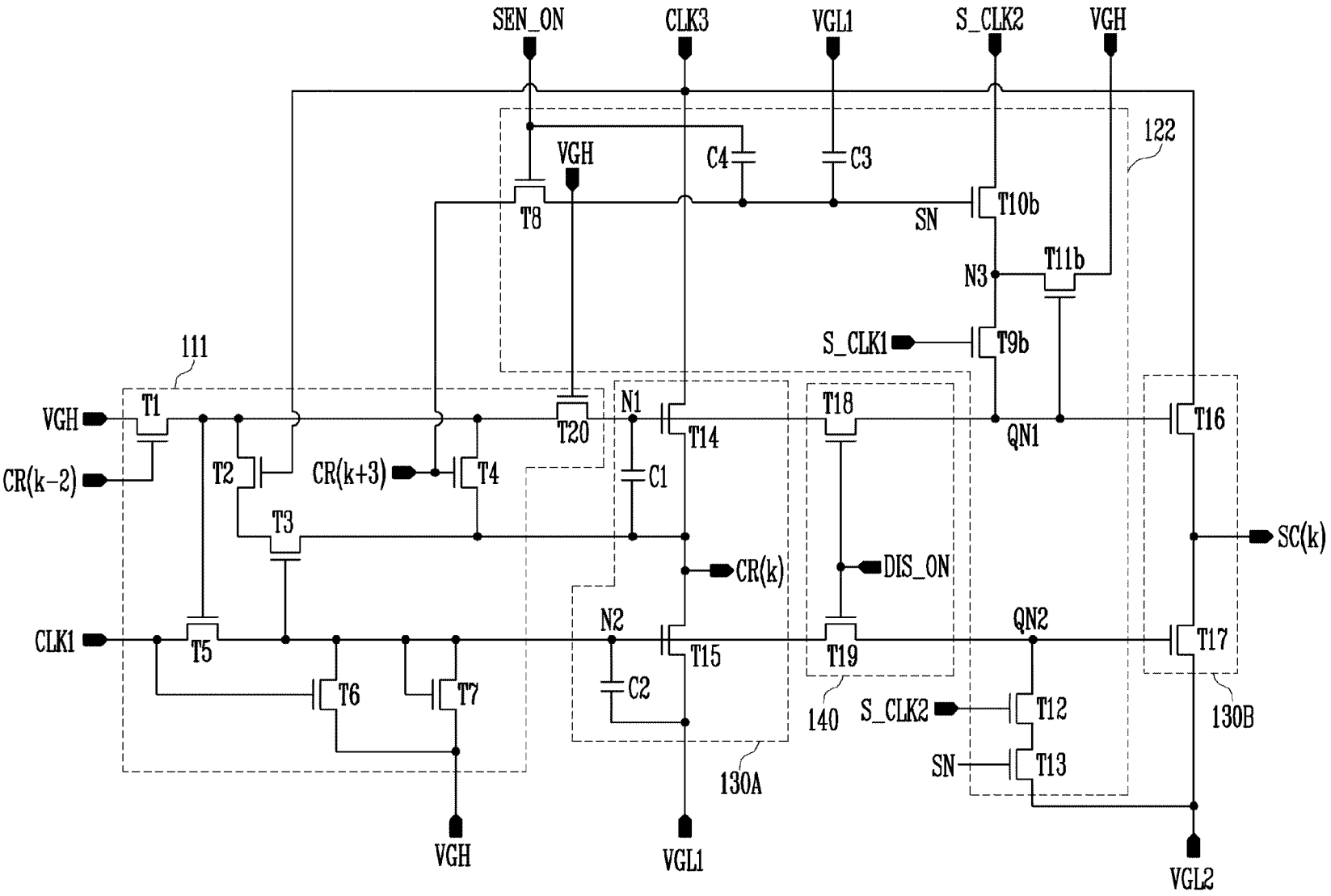
FIG. 13A is a circuit diagram illustrating an exemplary stage included in the scan driver shown in FIG. 2.
Figure 13B:
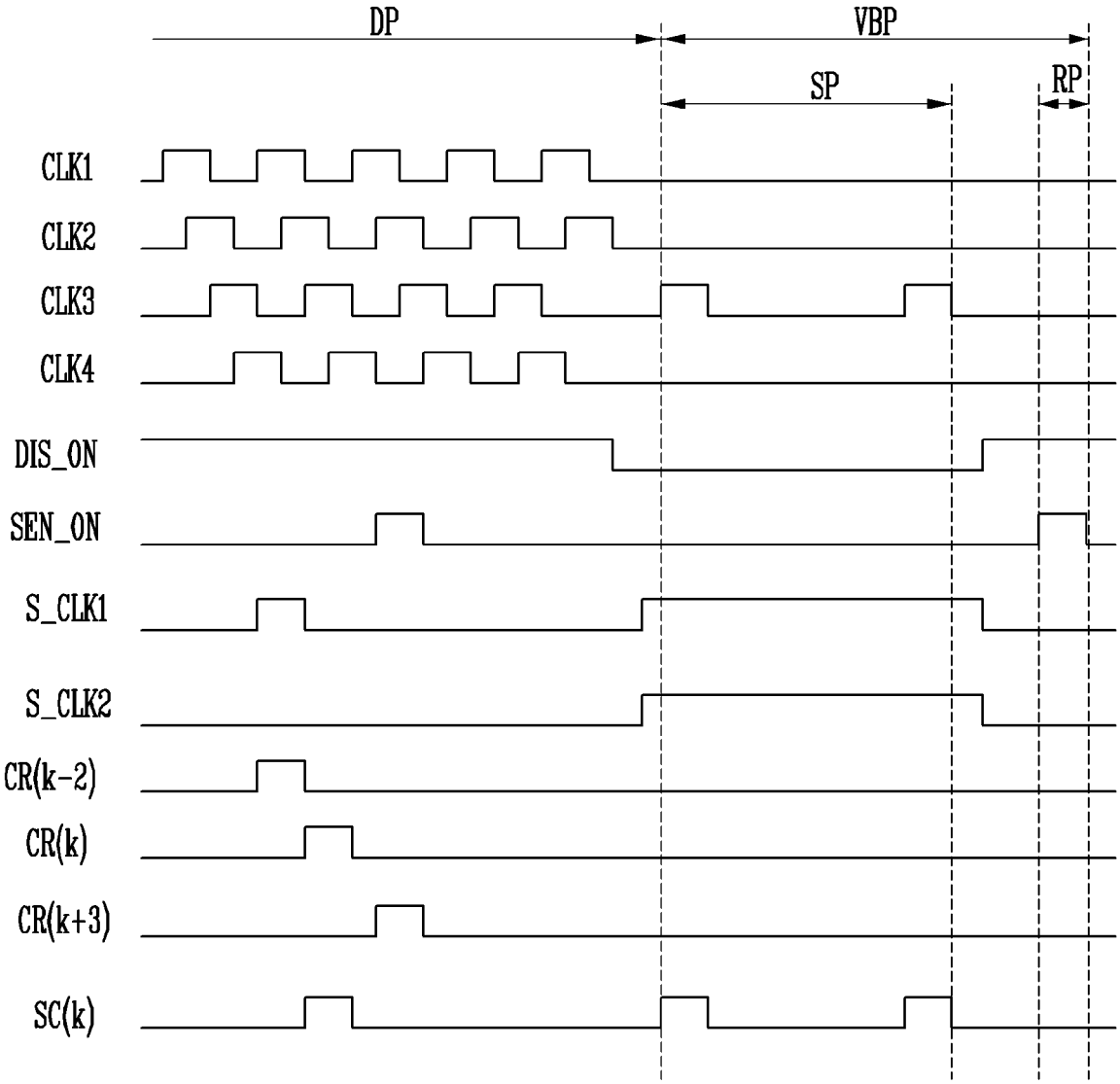
FIG. 13B is a timing diagram illustrating an exemplary operation of the stage shown in FIG. 13A.

FIG. 13A is a circuit diagram illustrating an exemplary stage included in the scan driver shown in FIG. 2. FIG. 13B is a timing diagram illustrating an exemplary operation of the stage shown in FIG. 13A.

In FIGS. 13A and 13B, components identical to those described with reference to FIGS. 3, 4, and 6 are designated by like reference numerals, and their overlapping descriptions will be omitted. In addition, the stage shown in FIG. 13A may have a configuration substantially identical or similar to that of the stage STk1*a* shown in FIG. 6, except the configuration of a second driving controller 122.

Referring to FIGS. 3, 6, 13A, and 13B, a k-th stage may include a first driving controller 111, a second driving controller 122, output buffers 130A and 130B, and a connection controller 140.

The second driving controller 122 may control a voltage of a second driving node QN2.

The second driving controller 122 may include a ninth transistor T9*b*, a tenth transistor T10*b*, and an eleventh transistor T11*b*.

The ninth transistor T9*b* may be coupled between a third node N3 and a first driving node QN1. The ninth transistor T9*b* may include a gate electrode that receives a first sensing clock signal S_CLK1.

The tenth transistor T10*b* may be coupled between a clock terminal to which a second sensing clock signal S_CLK2 is applied and the third node N3. The tenth transistor T10*b* may include a gate electrode coupled to a sampling node SN.

The eleventh transistor T11*b* may be coupled between the first power terminal V1 to which the first power source VGH is applied and the third node N3. The eleventh transistor T11*b* may include a gate electrode coupled to the first driving node QN1.

As shown in FIG. 13B, the second sensing clock signal S_CLK2 may have the same waveform as the sensing clock signal S_CLK.

Meanwhile, in an exemplary embodiment, the first sensing clock signal S_CLK1 may have the same waveform as the second sensing clock signal S_CLK2 in the vertical blank period VBP, and have the same waveform as a predetermined carry signal in the display period DP.

The stages shown in FIGS. 3 and 6 may charge the voltage of the first driving node QN1 with the sensing clock signal S_CLK in dependence on only the voltage of the sampling node SN during the mobility sensing period SP. However, the stage shown in FIG. 13A may charge a stable gate-on voltage in the first driving node QN1, not only using the voltage of the sampling node SN but also using the second sensing clock signal S_CLK2, during the mobility sensing period SP. For example, a conductive path passing through the tenth transistor T10*b* and the ninth transistor T9*b* may be further formed during the mobility sensing period SP, and the second driving controller 122 may assist (supplement) a voltage charge in the first driving node QN1.

Also, the stage shown in FIGS. 3 and 6 may charge the voltage of the first driving node QN1 in dependence on only the voltage of the first node N1 during the display period DP. However, in the stage shown in FIG. 13A, the ninth transistor T9*b* is turned on in synchronization with the (k−2)th carry signal CR(k−2), so that the voltage of the first power source VGH can be applied to the first driving node QN1 through the ninth transistor T9*b*. That is, the stage shown in FIG. 13A may charge a stable gate-on voltage in the first driving node QN1, not only using the voltage of the first node N1 but also using the first power source VGH, during the display period DP. For example, a conductive path passing through the eleventh transistor T11*b* and the ninth transistor T9*b* may be further formed during the display period DP, and the second driving controller 122 may assist (supplement) the voltage charge in the first driving node QN1.

In an exemplary embodiment, an operation of the first sensing clock signal S_CLK1 in the display period DP may be changed depending on an ambient temperature. When the display device operates at a high temperature, it is unnecessary for the second driving controller 122 to assist the voltage charge of the first driving node QN1. Therefore, at a preset threshold temperature or more, the first sensing clock signal S_CLK1 may maintain a gate-off voltage during the display period DP. Only when the display device operates at a temperature lower than the threshold temperature, the first sensing clock signal S_CLK1 may have a gate-on voltage in synchronization with the (k−2)th carry signal CR(k−2).

Meanwhile, the first sensing clock signal S_CLK1 may be a global signal. Therefore, in order to assist the voltage charge of the first driving node QN1 in stages corresponding to a plurality of pixel rows, the first sensing clock signal S_CLK1 may have a gate-on voltage plural times during the display period DP.

As described above, the scan driver according to the exemplary embodiment holds a voltage of the third node N3 as a predetermined voltage, so that an unnecessary drain-source voltage increase of the ninth transistor T9*b* can be prevented or reduced. In addition, a gate-on voltage can be stably charged in the first driving node QN1 during the display period and the mobility sensing period. Thus, the reliability of the output of the scan signal SC(k) can be further improved.

Figure 14:
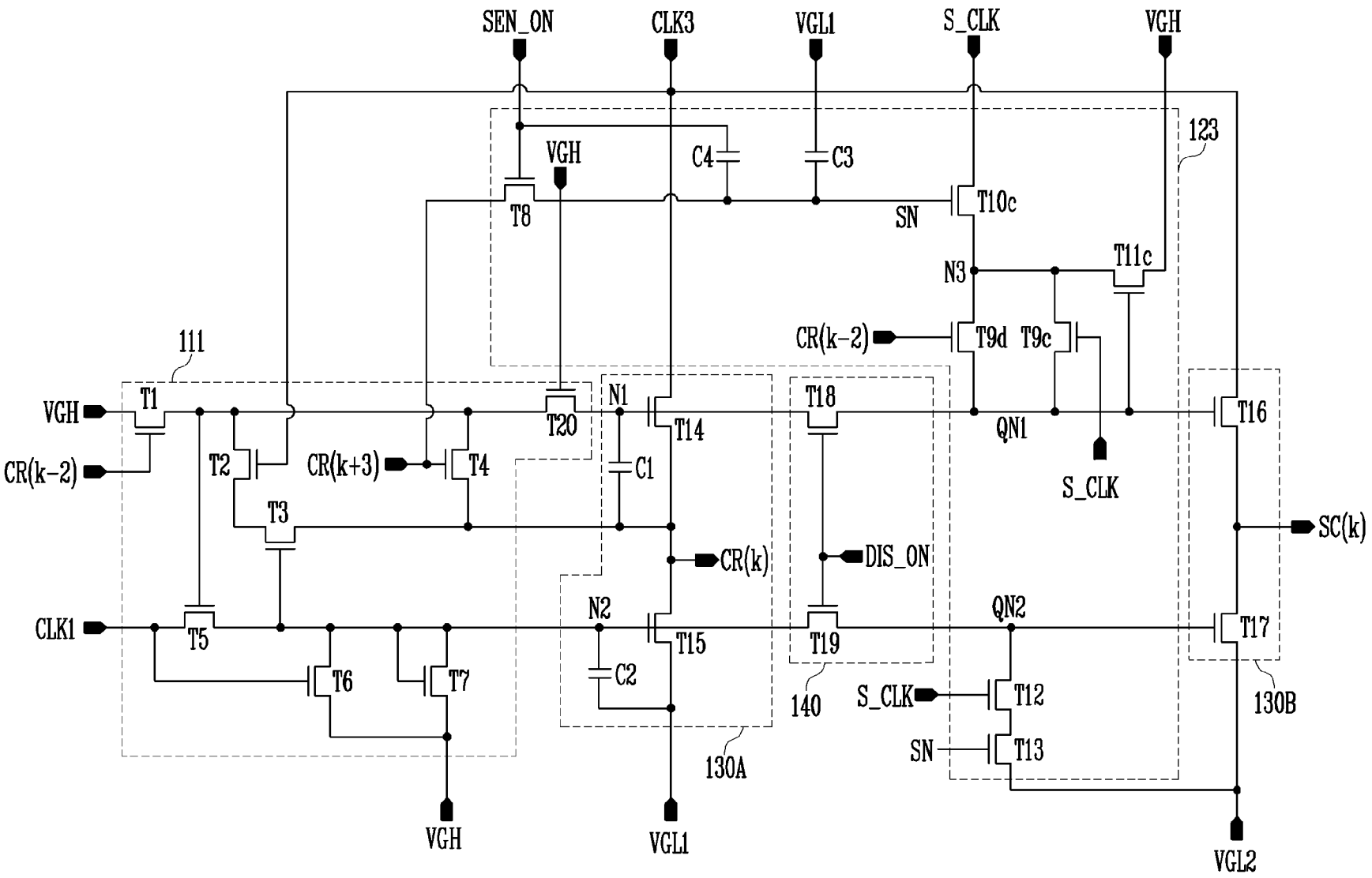
FIG. 14 is a circuit diagram illustrating an exemplary stage included in the scan driver shown in FIG. 2.

FIG. 14 is a circuit diagram illustrating an exemplary stage included in the scan driver shown in FIG. 2.

In FIG. 14, components identical to those described with reference to FIGS. 3, 4, 6, and 13A are designated by like reference numerals, and their overlapping descriptions will be omitted. In addition, the stage shown in FIG. 14 may have a configuration substantially identical or similar to that of the stage shown in FIG. 13A, except the configuration of a second driving controller 123.

Referring to FIGS. 3, 4, 6, 13A, and 14, a k-th stage may include a first driving controller 111, a second driving controller 123, output buffers 130A and 130B, and a connection controller 140.

The second driving controller 123 may control a voltage of a first driving node QN1.

The second driving controller 123 may include ninth transistors T9*c* and ninth T9*d*, a tenth transistor T10*c*, and an eleventh transistor T11*c*.

The tenth transistor T10*c* and the eleventh transistor T11*c* may be respectively identical to the tenth transistor T10*b* and the eleventh transistor T11*b*, which are shown in FIG. 13A.

The ninth transistor T9*c* may be coupled to a third node N3 and the first driving node QN1. The ninth transistor T9*c* may include a gate electrode that receives a sensing clock signal S_CLK. The sensing clock signal S_CLK may have the same waveform as the second sensing clock signal S_CLK2 shown in FIG. 13B.

The ninth transistor T9*d* (or additional ninth transistor) may be coupled between the third node N3 and the first driving node QN1. The ninth transistor T9*d* may include a gate electrode that receives a previous carry signal (e.g., the (k−2)th carry signal CR(k−2)).

The ninth transistor T9*c* and the eleventh transistor T11*c* are turned on during the mobility sensing period SP, so that a gate-on voltage can be stably charged in the first driving node QN1.

In the display period DP, the ninth transistor T9*d* may be turned on by the (k−2)th carry signal CR(k−2), and the voltage of the first driving node QN1 may be supplementarily charged through the eleventh transistor T11*c* and the ninth transistor T9*d*. That is, a voltage charge in the first driving node QN1, which is caused by a voltage charge in the first node N1, may be reinforced by the eleventh transistor T11*c* and the ninth transistor T9*d* in the display period DP.

Substantially, the stage shown in FIG. 14 may be driven using the signal waveforms shown in FIG. 4. That is, the additional sensing clock signal shown in FIG. 13A is not required.

As described above, the scan driver according to the exemplary embodiment holds a voltage of the third node N3 as a predetermined voltage, so that an unnecessary drain-source voltage increase of the ninth transistor T9*d* can be prevented or reduced. In addition, a gate-on voltage is stably charged in the first driving node QN1 during the mobility sensing period, and can be more stably charged in the first driving node QN1 even in the display period. Thus, the reliability of the output of the scan signal SC(k) can be further improved.

Figure 15:
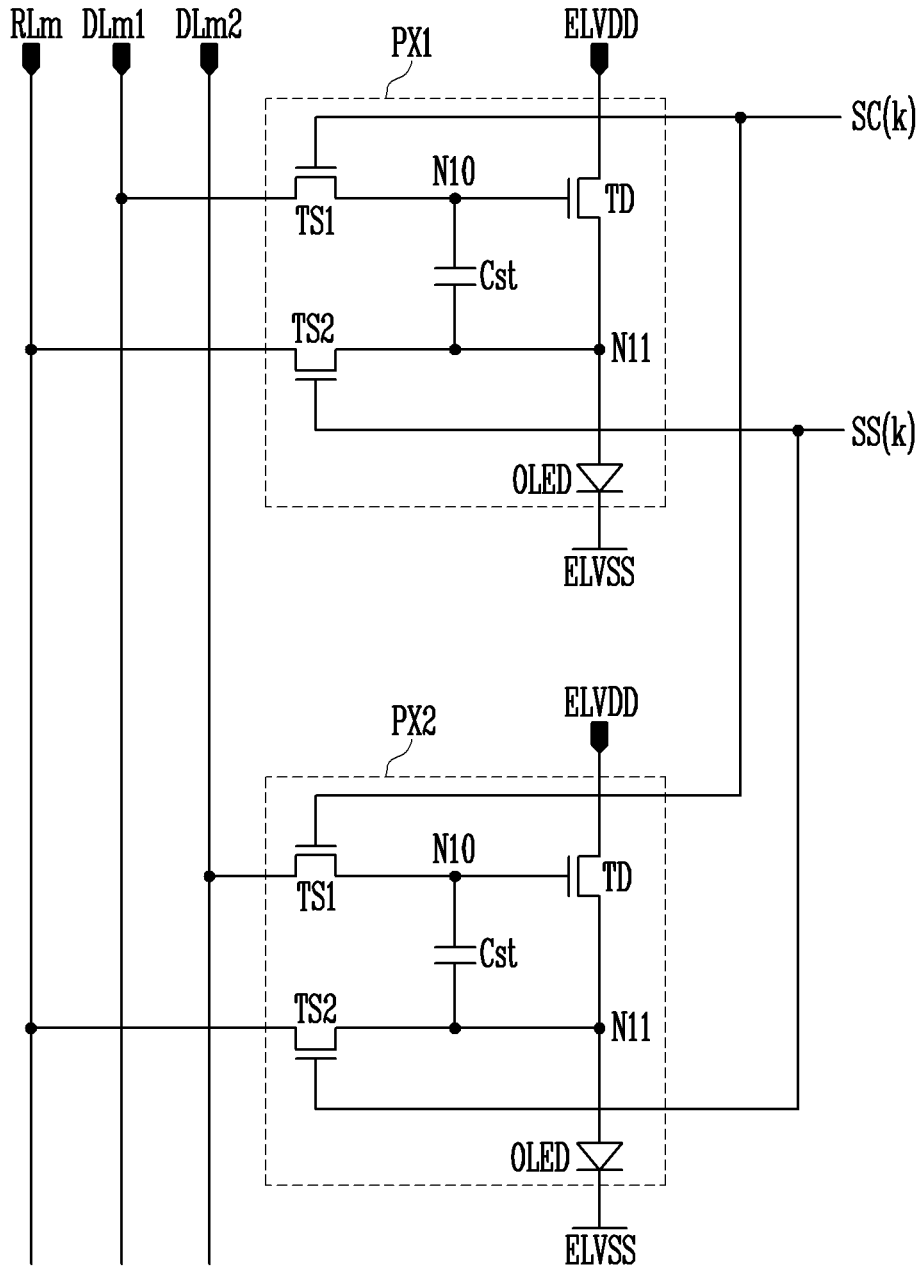
FIG. 15 is a circuit diagram illustrating an example of pixels included in the display device shown in FIG. 1.

FIG. 15 is a circuit diagram illustrating an exemplary pixels included in the display device shown in FIG. 1.

Pixels PX1 and PX2 shown in FIG. 15 may receive a k-th scan signal SC(k) and a k-th sensing signal SS(k).

Referring to FIG. 15, each of the pixels PX1 and PX2 may include an organic light emitting diode OLED, a driving transistor TD, a first switching transistor TS1, a second switching transistor TS2, and a storage capacitor Cst.

A first pixel PX1 may be disposed on a k-th pixel row, and a second pixel PX2 may be disposed on a (k+1)th pixel row. The first and second pixels PX1 and PX2 may be disposed on an mth (m is a natural number) pixel column. An m1th data line DLm1 may be coupled to the first pixel PX1, and an m2th data line DLm2 may be coupled to the second pixel PX2. An mth readout line RLm may be coupled to the first and second pixels PX1 and PX2.

Hereinafter, a configuration of the first pixel PX1 will be mainly described. The second pixel PX2 has a configuration substantially identical to that of the first pixel PX1, except that the second pixel PX2 is coupled to a data line different from that to which the first pixel PX1 is coupled.

An anode electrode of the organic light emitting diode OLED may be coupled to a second electrode of the driving transistor TD, and a cathode electrode of the organic light emitting diode OLED may be coupled to a second driving power source ELVSS. The organic light emitting diode OLED generates light with a predetermined luminance corresponding to an amount of current supplied from the driving transistor TD.

A first electrode of the driving transistor TD may be coupled to a first driving power source ELVDD, and the second electrode of the driving transistor TD may be coupled to the anode electrode of the organic light emitting diode OLED. A gate electrode of the driving transistor TD may be coupled to a tenth node N10. The driving transistor TD controls an amount of current flowing through the organic light emitting diode OLED, corresponding to a voltage of the tenth node N10.

A first electrode of the first switching transistor TS1 may be coupled to the m1th data line DLm1, and a second electrode of the first switching transistor TS1 may be coupled to the tenth node N10. A gate electrode of the first switching transistor TS1 may be coupled to a scan line. The first switching transistor TS1 may be turned on when a k-th scan signal SC(k) is supplied to the scan line, to transfer a data voltage from the m1th data line DLm1 to the tenth node N10.

The second switching transistor TS2 may be coupled between the readout line RLm and the first electrode (i.e., an eleventh node N11) of the driving transistor TD. The second switching transistor TS2 may transfer a sensing current to the readout line RLm in response to a sensing signal SS(k) transferred through a sensing line. The sensing current may be used to calculate a variation in mobility and threshold voltage of the driving transistor TD. Mobility and threshold voltage information may be calculated according to the relationship between the sensing current and a voltage for sensing. In an exemplary embodiment, the sensing current may be converted into a voltage form to be used in a compensation operation of the data voltage.

The storage capacitor Cst may be coupled between the tenth node N10 and the anode electrode of the organic light emitting diode OLED. The storage capacitor Cst stores a voltage of the tenth node N10.

In an exemplary embodiment, in a display period, data voltages corresponding to the first pixel PX1 and the second pixel PX2 may be simultaneously applied to the data lines DLm1 and DLm2, respectively. In a sensing period (e.g., a threshold voltage sensing period, a mobility sensing period, or an organic light emitting diode sensing period) except the display period, voltages for sensing may be simultaneously applied to the data lines DLm1 and DLm2, respectively.

In an exemplary embodiment, the scan signal SC(k) and the sensing signal SS(k) are simultaneously applied to the first and second pixels PX1 and PX2, and therefore, data voltages may be simultaneously applied to the first and second pixels PX1 and PX2.

Figure 16:
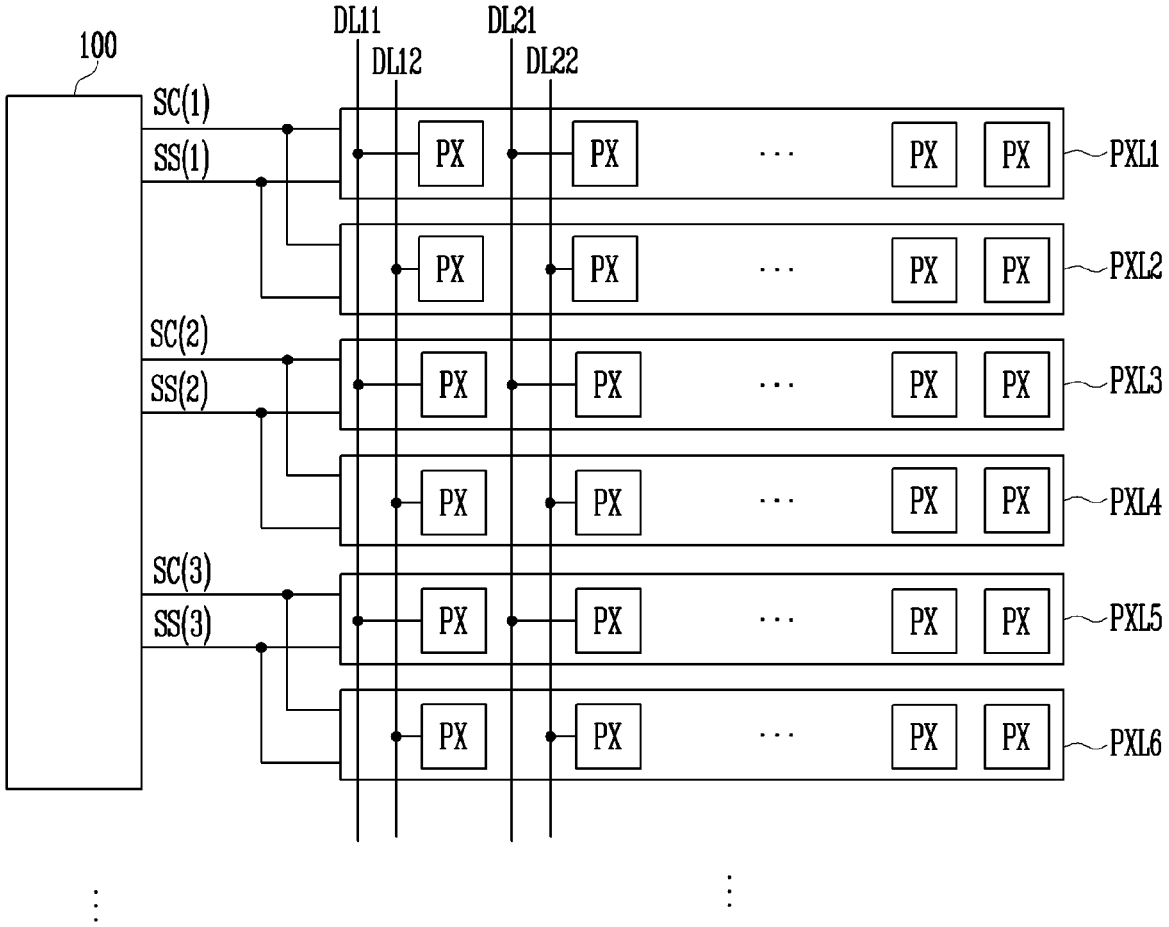
FIG. 16 is a diagram illustrating an example of signals supplied to the pixels included in the display device shown in FIG. 1.

FIG. 16 is a diagram illustrating an example of signals supplied to the pixels included in the display device shown in FIG. 1.

Referring to FIGS. 15 and 16, one scan signal and one sensing signal may be simultaneously supplied to two adjacent pixel rows.

A first scan signal SC(1) may be commonly supplied to a first pixel row PXL1 and a second pixel row PXL2. A second scan signal SC(2) may be commonly supplied to a third pixel row PXL3 and a fourth pixel row PXL4. In this manner, one scan signal may be simultaneously supplied to two adjacent pixel rows.

A first sensing signal SS(1) may be commonly supplied to the first pixel row PXL1 and the second pixel row PXL2. A second sensing signal SS(2) may be commonly supplied to the third pixel row PXL3 and the fourth pixel row PXL4. In this manner, one sensing signal may be simultaneously supplied to two adjacent pixel rows.

These scan signals and sensing signals may be generated and output from the scan drivers and the stage circuits according to the exemplary embodiments shown in FIGS. 2, 3, 4, 5, 6A, 6B, 7, 8, 9, 10, 11, 12, 13A, 13B, and 14.

Some data lines may be coupled to pixels disposed on odd-numbered pixel rows. The other data lines may be coupled to pixels disposed on even-numbered pixel rows.

Accordingly, a problem of decreased data voltage charging rate in a high resolution display device of 4k Ultra-High Definition (UHD) image quality may be prevented or decreased.

The scan driver 100 may include a plurality of stages that output scan signals SC(1), SC(2), SC(3), . . . SC(i) and sensing signals SS(1), SS(2), SS(3), . . . SS(i).

In an exemplary embodiment, as shown in FIG. 10, one stage may output both a scan signal and a sensing signal. The scan driver 100 may include n stages corresponding to 2n pixel rows.

In an exemplary embodiment, as shown in FIGS. 3 and 6, the scan driver 100 may include stages that output scan signals and stages that output sensing signals. The scan driver 100 may include 2n stages corresponding to 2n pixel rows.

As described above, a signal output from a stage may be defined as one of a scan signal and a sensing signal depending on transistors of a pixel coupled thereto.

Figure 17:
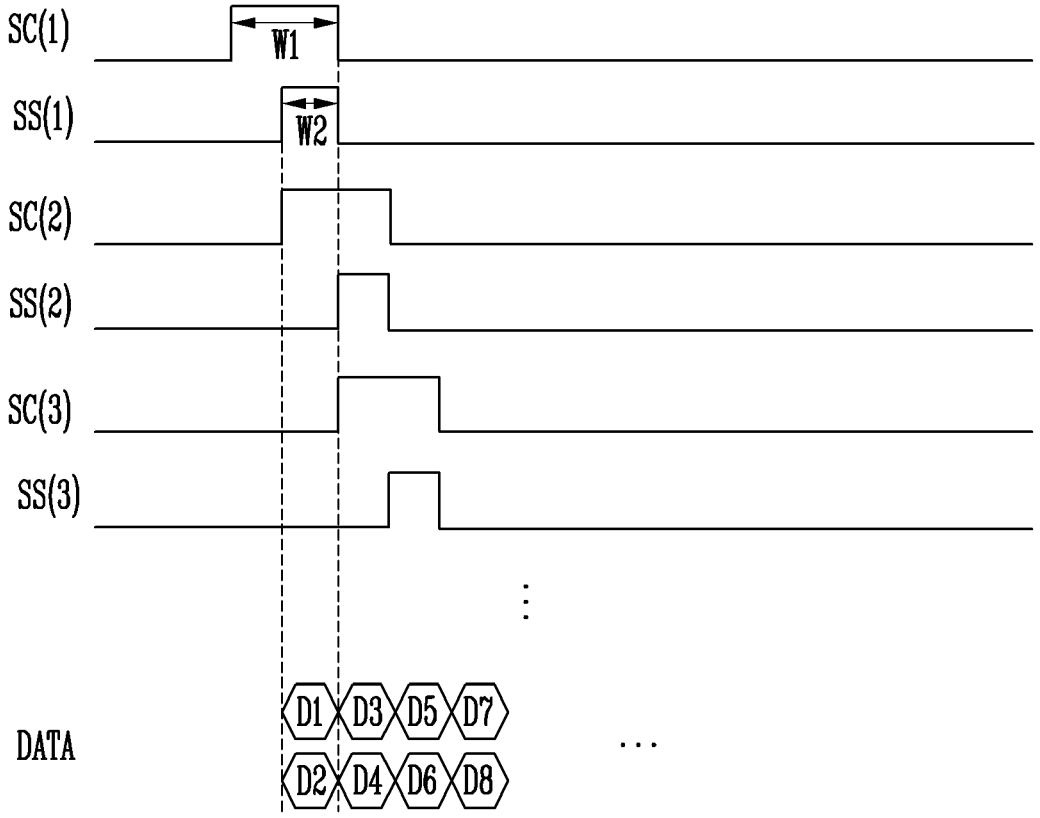
FIG. 17 is a diagram illustrating an example of signals supplied to the pixels shown in FIG. 15 in a display period.

FIG. 17 is a diagram illustrating an example of signals supplied to the pixels shown in FIG. 15 in a display period.

Figure 18:
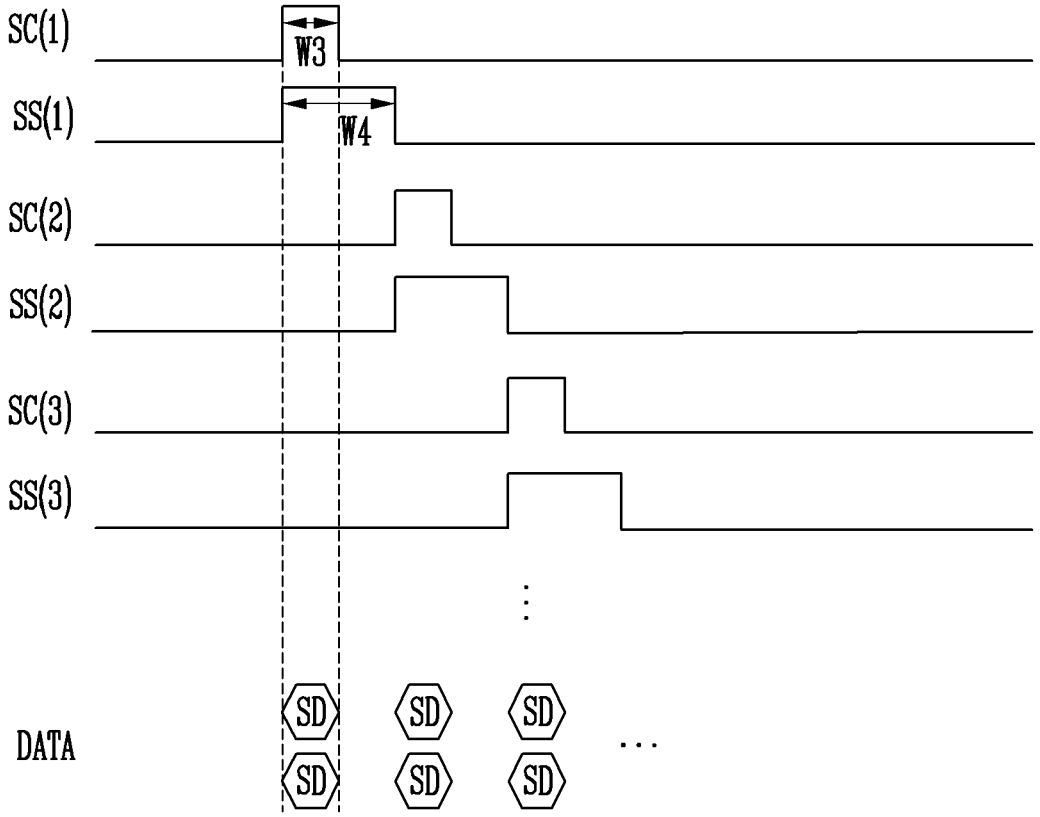
FIG. 18 is a diagram illustrating an example of signals supplied to the pixels shown in FIG. 15 in a sensing period.

FIG. 18 is a diagram illustrating an example of signals supplied to the pixels shown in FIG. 15 in a sensing period.

Referring to FIGS. 15, 16, 17, and 18, each of scan signals and sensing signals may be commonly applied in units of two pixel rows.

For example, the first scan signal SC(1) and the first sensing signal SS(1) may be commonly supplied to the first and second pixels PXL1 and PXL2.

As shown in FIG. 17, each of a scan signal and a sensing signal may be sequentially supplied during the display period.

In an exemplary embodiment, a width W1 of the scan signal may be larger than that W2 of the sensing signal in the display period. Each of the width W1 of the scan signal and the width W2 of the sensing signal may mean a gate-on voltage period.

For example, the width W1 of the scan signal may correspond to four horizontal periods 4H, and the width W2 of the sensing signal may correspond to two horizontal periods 2H. Accordingly, data write may be performed two horizontal periods or more, which is a sufficient time. However, this is merely illustrative, and the width W1 of the scan signal and the width W2 of the sensing signal are not limited thereto.

In an exemplary embodiment, in the display period, data voltages of pixel rows to which a k-th scan signal and a k-th sensing signal are supplied may be supplied in a period in which the k-th scan signal and the k-th sensing signal overlap with each other. For example, a first data voltage D1 and a second data voltage D2 may be supplied to the first pixel row PXL1 and the second pixel row PXL2 in a period in which the first scan signal SC(1) and the first sensing signal SS(1) overlap with each other. Similarly, a third data voltage D3 and a fourth data voltage D4 may be supplied to the third pixel row PXL3 and the fourth pixel row PXL4 in a period in which the second scan signal SC(2) and the second sensing signal SS(2) overlap with each other.

In an exemplary embodiment, the signal supply shown in FIG. 17 may be performed so as to sense a threshold voltage when the display device is turned off. For example, supply timings of the scan signal and the sensing signal in a threshold voltage sensing period and the display period may be the substantially same.

Accordingly, two horizontal periods 2H or more can be secured as a data write time, so that a problem of reduced data voltage charging rate in a high resolution display device may be prevented or decreased.

As shown in FIG. 18, a scan signal and a sensing signal may be supplied in a mobility sensing period. Although a case where each of the scan signal and the sensing signal is sequentially supplied to pixel rows is illustrated in FIG. 18, the present disclosure is not limited thereto. For example, in the mobility sensing period, only one scan signal and one sensing signal may be output to pixel rows corresponding thereto.

In an exemplary embodiment, a width W3 of the scan signal may be smaller than that W4 of the sensing signal in the mobility sensing period. For example, the width W3 of the scan signal may correspond to four horizontal periods 4H, and the width W4 of the sensing signal may correspond to eight horizontal periods 8H. However, this is merely illustrative, and the width W3 of the scan signal and the width W4 of the sensing signal are not limited thereto.

In an exemplary embodiment, in the mobility sensing period, data voltages of pixel rows to which a k-th scan signal and a k-th sensing signal are supplied may be supplied in a period in which the k-th scan signal and the k-th sensing signal overlap with each other.

In the mobility sensing period, the gate electrode of the driving transistor TD is to have a floating state so as to maintain a voltage (e.g., a gate-source voltage Vgs of the driving transistor TD) stored in the storage capacitor Cst. Therefore, the width W3 of the scan signal may be smaller than that W4 of the sensing signal in the mobility sensing period.

In an exemplary embodiment, in the mobility sensing period, a sensing voltage SD for sensing may be supplied to the pixel rows to which the k-th scan signal and the k-th sensing signal are supplied in a period in which the k-th scan signal and the k-th sensing signal overlap with each other. Accordingly, the sensing voltage SD may be simultaneously applied to two consecutive pixel rows. For example, the sensing voltage SD may be supplied to the first pixel row PXL1 and the second pixel row PXL2 in a period in which the first scan signal SC(1) and the first sensing signal SS(1) overlap with each other.

Accordingly, mobility sensing on two pixel rows can be performed in one mobility sensing period.

Figure 19:
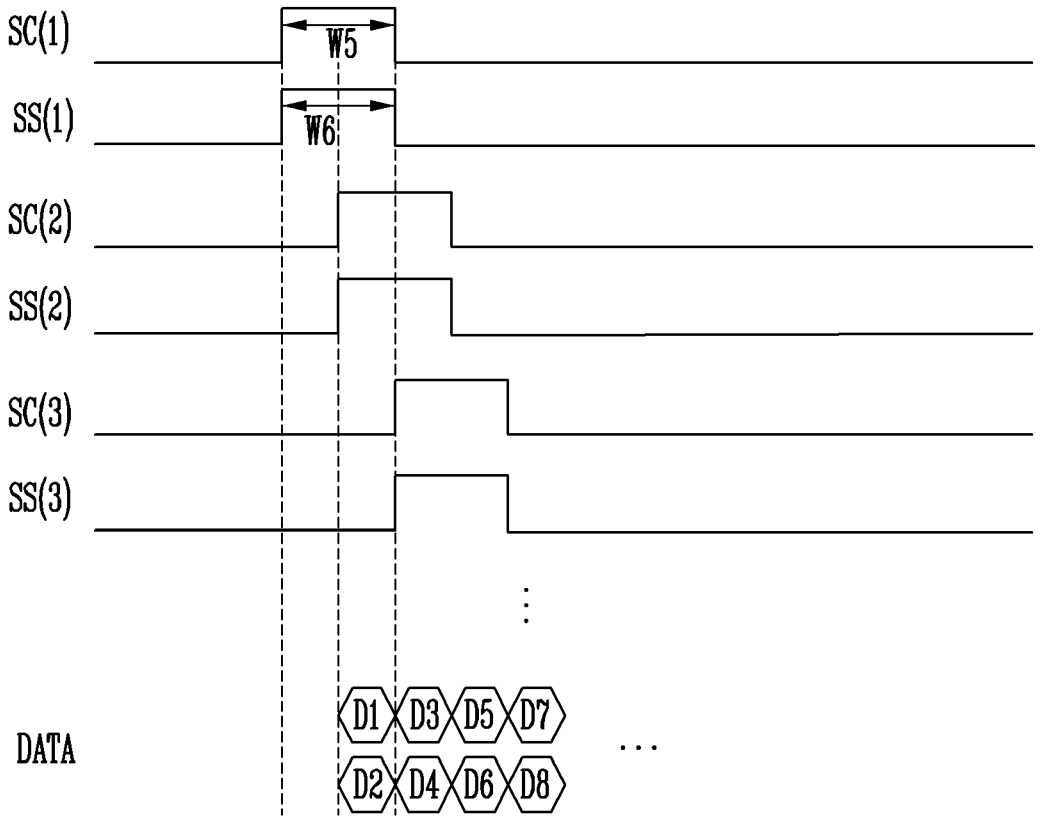
FIG. 19 is a diagram illustrating an exemplary signals supplied to the pixels shown in FIG. 15 in the display period.
Figure 20:
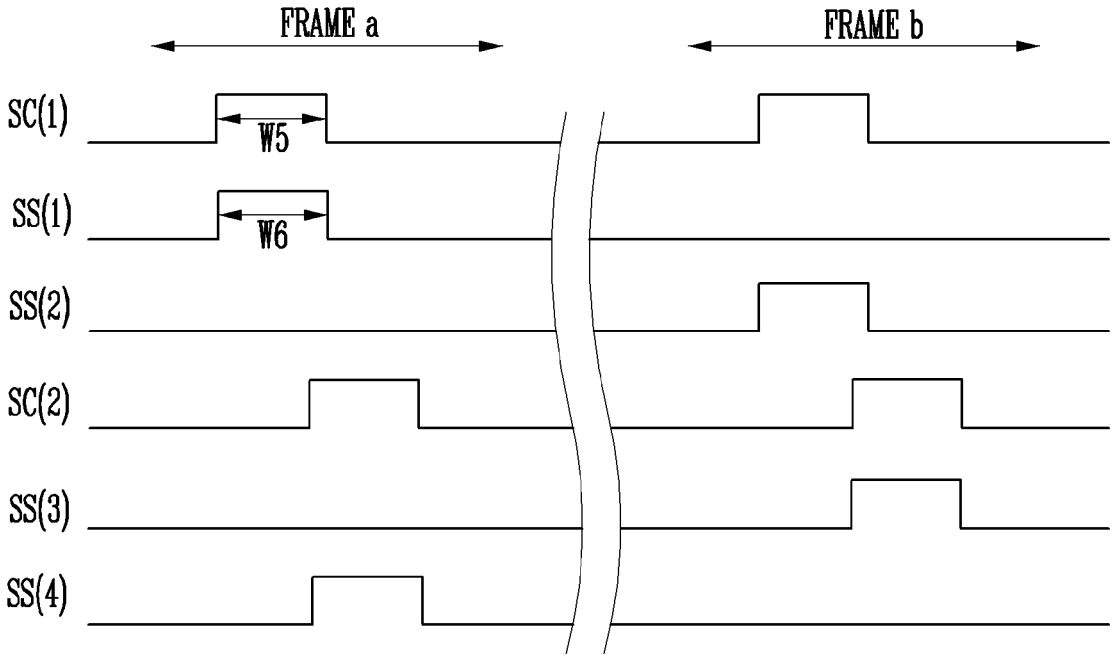
FIG. 20 is a diagram illustrating an exemplary signals supplied to the pixels shown in FIG. 15 in the sensing period.

FIG. 19 is a diagram illustrating an exemplary signals supplied to the pixels shown in FIG. 15 in the display period. FIG. 20 is a diagram illustrating an exemplary signals supplied to the pixels shown in FIG. 15 in the sensing period.

Operations in the display period and the mobility sensing period, which are shown in FIGS. 19 and 20, are substantially identical to those shown in FIGS. 17 and 18, except widths of signals, and therefore, their overlapping descriptions will be omitted.

Referring to FIGS. 15, 16, 17, 18, 19, and 20, the display device may output scan signals and sensing signals in the display period and the mobility sensing period.

For example, the first scan signal SC(1) and the first sensing signal SS(1) may be commonly supplied to the first and second pixel rows PXL1 and PXL2.

As shown in FIG. 19, in the display period, a width W5 of the scan signal may be equal to that W6 of the sensing signal. In addition, a k-th scan signal and a k-th sensing signal may be output during the same period.

In an exemplary embodiment, data voltages of pixel rows to which the k-th scan signal is supplied may be supplied in a period in which the k-th scan signal and a (k+1)th scan signal overlap with each other. For example, a first data voltage D1 and a second data voltage D2 may be respectively supplied to the first and second pixel rows PXL1 and PXL2 in a period in which the first scan signal SC(1) and the second scan signal SC(2) overlaps with each other.

In an exemplary embodiment, as shown in FIG. 20, sensing signals SS(1) to SS(4) may be respectively supplied to pixel rows. For example, the first sensing signal SS(1) may be supplied to the first pixel row PXL1 and the second pixel row PXL2, the first sensing signal SS(1) may be supplied to the first pixel row PXL1, and the second sensing signal SS(2) may be supplied to the second pixel row PXL2.

For example, a (2k−1)th sensing signal SS(2k−1) and a 2k-th sensing signal SS(2k) may correspond to the k-th scan signal SC(k).

FIG. 20 illustrates scan signals and sensing signals, which are supplied in the sensing period. In an exemplary embodiment, during the sensing period, sensing (e.g., threshold voltage sensing or mobility sensing) may be performed on only one pixel row.

For example, in a sensing period of frame period FRAME a, only a first sensing signal SS(1) corresponding to the first scan signal SC(1) may be output, and a sensing operation on the first pixel row PXL1 may be performed. Subsequently, in a sensing period of frame period FRAME b, only a second sensing signal SS(2) corresponding to the first scan signal SC(1) may be output, and a sensing operation on the second pixel row PXL2 may be performed.

For example, in the sensing period of the frame period FRAME a, only a fourth sensing signal SS(4) corresponding to the second scan signal SC(2) may be output, and a sensing operation on the fourth pixel row PXL4 may be performed. Subsequently, in the sensing period of the frame period FRAME b, only a third sensing signal SS(3) corresponding to the second scan signal SC(2) may be output, and a sensing operation on the third pixel row PXL3 may be performed.

Accordingly, in order to prevent or reduce the problem of reduced data voltage charging rate, data of two horizontal periods 2H or more may be simultaneously written in the display period, and a sensing operation may be performed for every one pixel row in the sensing period. Thus, the sensing and compensation accuracy can be improved.

The present disclosure can be applied to an arbitrary electronic device including a display device. For example, the present disclosure can be applied to HMD devices, TVs, digital TVs, 3D TVs, PCs, home appliances, notebook computers, tablet computers, mobile phones, smart phones, PDAs, PMPs, digital cameras, music players, portable game consoles, navigation systems, wearable displays, and the like.

The scan driver according to the present disclosure prevents or reduces an excessive increase in drain-source voltages of transistors coupled to the first driving node, and stabilizes a voltage of the first driving node and a voltage of the first node, so that a scan signal can be stably output even in long-time use.

Further, the display device according to the present disclosure includes the scan driver, so that the reliability of the display device can be improved. In addition, a problem of reduced data voltage charging rate in a high resolution display device of 4k UHD image quality may be prevented or decreased.

What is claimed is:

1. A scan driver comprising: a plurality of stages each configured to transmit a scan signal and a carry signal, the plurality of stages comprising an n-th stage comprising:

a first driving controller configured to control a voltage of a first node and a voltage of a second node in response to a previous carry signal, the previous carry signal being a carry signal transmitted from a stage preceding the n-th stage;

a second driving controller configured to:

control a voltage of a first driving node, based on a sensing-on signal, a next carry signal, a voltage of a first power source, the voltage of the first node, and a voltage of a sampling node, the next carry signal being a carry signal transmitted from a stage succeeding the n-th stage; and control a voltage of a second driving node, based on the voltage of the sampling node and a sensing clock signal;

an output buffer configured to:

transmit the carry signal in response to the voltage of the first node and the voltage of the second node; and transmit the scan signal in response to the voltage of the first driving node and the voltage of the second driving node; and a connection controller configured to electrically couple the first node and the first driving node to each other and electrically couple the second node and the second driving node to each other, in response to a display-on signal, wherein n is a natural number.

2. The scan driver of claim 1, wherein the second driving controller comprises:

an eighth transistor coupled between an input terminal to which the next carry signal is applied and the sampling node, the eighth transistor comprising a gate electrode configured to receive the sensing-on signal;

a ninth transistor and a tenth transistor coupled in series between a clock terminal to which the sensing clock signal is applied and the first driving node, the ninth and tenth transistors comprising gate electrodes commonly coupled to the sampling node; and an eleventh transistor coupled between a first power terminal to which the first power source is applied and a third node between the ninth and tenth transistors, the eleventh transistor comprising a gate electrode coupled to the first driving node.

3. The scan driver of claim 2, wherein, the eleventh transistor is configured to supply the voltage of the first power source to the third node based on the voltage of the first driving node, in response to the sensing clock signal being supplied.

4. The scan driver of claim 2, wherein one frame period comprises a display period and a vertical blank period, wherein, in the display period, the sensing-on signal is supplied to the n-th stage that is one of the stages.

5. The scan driver of claim 4, wherein the n-th stage is configured to output the scan signal in the vertical blank period continued to the display period.

6. The scan driver of claim 4, wherein the sensing-on signal is applied in synchronization with the next carry signal in the display period.

7. The scan driver of claim 6, wherein the next carry signal is an (n+3)th carry signal being a carry signal transmitted from an (n+3)th stage.

8. The scan driver of claim 2, wherein the second driving controller further comprises:

a capacitor coupled between a second power terminal to which a second power source is applied and the sampling node; and a twelfth transistor and a thirteenth transistor coupled in series between a third power terminal to which a third power source is applied and the second driving node, wherein the twelfth transistor comprises a gate electrode configured to receive the sensing clock signal, and the thirteenth transistor comprises a gate electrode coupled to the sampling node.

9. The scan driver of claim 1, wherein the second driving controller comprises:

an eighth transistor coupled between an input terminal to which the next carry signal is applied and the sampling node, the eighth transistor comprising a gate electrode configured to receive the sensing-on signal;

a ninth transistor and a tenth transistor coupled in series between a clock terminal to which the sensing clock signal is applied and the first driving node, the ninth and tenth transistors comprising gate electrodes commonly coupled to the sampling node; and an eleventh transistor diode-coupled between a carry output terminal configured to transmit the carry signal and a third node between the ninth and tenth transistors or between the third node and an output terminal configured to transmit the scan signal, wherein the next carry signal is an (n+3)th carry signal being a carry signal transmitted from an (n+3)th stage.

10. The scan driver of claim 1, wherein the second driving controller comprises:

an eighth transistor coupled between an input terminal to which the next carry signal is applied and the sampling node, the eighth transistor comprising a gate electrode configured to receive the sensing-on signal;

a ninth transistor coupled between a third node and the first driving node, the ninth transistor comprising a gate electrode configured to receive a first sensing clock signal;

a tenth transistor coupled between a clock terminal to which a second sensing clock signal is applied and the third node, the tenth transistor comprising a gate electrode coupled to the sampling node; and an eleventh transistor coupled between a power terminal to which the first power source is applied and the third node, the eleventh transistor comprising a gate electrode coupled to the first driving node, wherein the next carry signal is an (n+3)th carry signal being a carry signal transmitted from an (n+3)th stage.

11. The scan driver of claim 1, wherein the second driving controller comprises:

an eighth transistor coupled between an input terminal to which the next carry signal is applied and the sampling node, the eighth transistor comprising a gate electrode configured to receive the sensing-on signal;

a ninth transistor coupled between a third node and the first driving node, the ninth transistor comprising a gate electrode configured to receive the sensing clock signal;

a tenth transistor coupled between a clock terminal to which the sensing clock signal is applied and the third node, the tenth transistor comprising a gate electrode coupled to the sampling node;

an eleventh transistor coupled between a power terminal to which the first power source is applied and the third node, the eleventh transistor comprising a gate electrode coupled to the first driving node; and an additional transistor coupled between the third node and the first driving node, the additional transistor comprising a gate electrode configured to receive the previous carry signal, wherein the next carry signal is an (n+3)th carry signal being a carry signal transmitted from an (n+3)th stage.

12. The scan driver of claim 1, wherein the first driving controller comprises:

a first transistor coupled between a first power terminal to which the first power source is applied and the first node, the first transistor comprising a gate electrode configured to receive one of an (n−2)th carry signal and a scan start signal, the (n−2)th carry signal being a carry signal transmitted from an (n−2)th stage;

a second transistor and a third transistor coupled in series between the first node and a carry output terminal configured to transmit the carry signal;

a fourth transistor coupled between the first node and the carry output terminal, the fourth transistor comprising a gate electrode configured to receive an (n+3)th carry signal, the (n+3)th carry signal being a carry signal transmitted from an (n+3)th stage;

a fifth transistor coupled between a first clock terminal to which a first clock signal is applied and the second node, the fifth transistor comprising a gate electrode coupled to the first node;

a sixth transistor coupled between the first power terminal and the second node, the sixth transistor comprising a gate electrode coupled to the first clock terminal; and a seventh transistor diode-coupled between the first power terminal and the second node.

13. The scan driver of claim 12, wherein the first driving controller further comprises:

a twentieth transistor coupled between the gate electrode of the fifth transistor and the first node, the twentieth transistor comprising a gate electrode coupled to the first power terminal, wherein the twentieth transistor is configured to always maintain a turn-on state.

14. The scan driver of claim 1, wherein the output buffer comprises:

a fourteenth transistor coupled between a second clock terminal to which a clock signal is applied and a carry output terminal configured to transmit the carry signal, the fourteenth transistor comprising a gate electrode coupled to the first node;

a fifteenth transistor coupled between the carry output terminal and a second power terminal to which a second power source is applied, the fifteenth transistor comprising a gate electrode coupled to the second node;

a sixteenth transistor coupled between the second clock terminal and a first output terminal, the sixteenth transistor comprising a gate electrode coupled to the first driving node; and a seventeenth transistor coupled between a third power terminal to which a third power source is applied and the first output terminal, the seventeenth transistor comprising a gate electrode coupled to the second driving node.

15. The scan driver of claim 14, wherein the output buffer is further configured to transmit a sensing signal in response to the voltage of the first driving node and the voltage of the second driving node.

16. The scan driver of claim 15, wherein the output buffer further comprises:

a twenty-first transistor coupled between a clock terminal to which a sensing control clock signal is applied and a second output terminal, the twenty-first transistor comprising a gate electrode coupled to the first driving node; and a twenty-second transistor coupled between the third power terminal and the second output terminal, the twenty-second transistor comprising a gate electrode coupled to the second driving node.

17. The scan driver of claim 1, wherein the connection controller comprises:

an eighteenth transistor coupled between the first node and the first driving node, the eighteenth transistor comprising a gate electrode configured to receive the display-on signal; and a nineteenth transistor coupled between the second node and the second driving node, the nineteenth transistor comprising a gate electrode configured to receive the display-on signal.

18. The scan driver of claim 1, wherein the connection controller comprises:

eighteenth transistors coupled in series between the first node and the first driving node, the eighteenth transistors comprising gate electrodes configured to commonly receive the display-on signal;

a nineteenth transistor coupled between the second node and the second driving node, the nineteenth transistor comprising a gate electrode configured to receive the display-on signal; and a twenty-third transistor coupled between a power terminal to which the first power source is applied and a fourth node between the eighteenth transistors, the twenty-third transistor comprising a gate electrode coupled to the first driving node.

19. A display device comprising:

a plurality of pixels respectively coupled to scan lines, sensing control lines, readout lines, and data lines;

a scan driver comprising a plurality of stages respectively configured to supply a scan signal and sensing signal to the scan lines and the sensing control lines, the plurality of stages comprising an n-th stage;

a data driver configured to supply a data signal to the data lines; and a compensator configured to generate a compensation value for compensating degradation of the pixels, based on sensing values provided from the readout lines, wherein an n-th stage comprises:

a first driving controller configured to control a voltage of a first node and a voltage of a second node in response to a previous carry signal, the previous carry signal being a carry signal transmitted from a stage preceding the n-th stage;

a second driving controller configured to:

control a voltage of a first driving node coupled to the first node, based on a sensing-on signal, a next carry signal, a voltage of a first power source, the voltage of the first node, and a voltage of a sampling node, the next carry signal being a carry signal transmitted from a stage succeeding the n-th stage; and control a voltage of a second driving node, based on the voltage of the sampling node and a sensing clock signal;

an output buffer configured to:

transmit a carry signal in response to the voltage of the first node and the voltage of the second node; and transmit at least one of the scan signal and the sensing signal in response to the voltage of the first driving node and the voltage of the second driving node; and a connection controller configured to electrically couple the first node and the first driving node to each other and electrically couple the second node and the second driving node to each other, in response to a display-on signal, wherein n is a natural number.

20. The display device of claim 19, wherein one frame period comprises a display period and a vertical blank period, wherein, in the display period, the sensing-on signal is supplied to one of the plurality of stages.

21. The display device of claim 20, wherein, in the display period, a width of the scan signal is larger than that of the sensing signal.

22. The display device of claim 21, wherein data voltages of pixel rows to which an n-th scan signal and an n-th sensing signal are supplied are supplied in a period in which the n-th scan signal and the n-th sensing signal overlap with each other.

23. The display device of claim 20, wherein, in a mobility sensing period, a width of the scan signal is smaller than that of the sensing signal.

24. The display device of claim 23, wherein a sensing voltage is supplied in a period in which an n-th scan signal and an n-th sensing signal overlap with each other.

25. The display device of claim 19, wherein the second driving controller comprises:

an eighth transistor coupled between an input terminal to which the next carry signal is applied and the sampling node, the eighth transistor comprising a gate electrode configured to receive the sensing-on signal;

a ninth transistor and a tenth transistor coupled in series between a clock terminal to which the sensing clock signal is applied and the first driving node, the ninth and tenth transistors comprising gate electrodes commonly coupled to the sampling node; and an eleventh transistor coupled between a first power terminal to which the first power source is applied and a third node between the ninth and tenth transistors, the eleventh transistor comprising a gate electrode coupled to the first driving node.

26. The display device of claim 20, wherein the sensing-on signal is applied in synchronization with the next carry signal in the display period.

27. The display device of claim 26, wherein the next carry signal is an (n+3)th carry signal being a carry signal transmitted from an (n+3)th stage.

* * * * *